US006213341B1

(12) United States Patent
Keith, III et al.

(10) Patent No.: US 6,213,341 B1
(45) Date of Patent: Apr. 10, 2001

(54) SAFE FOR HOLDING AND DISPENSING CHANGE

(75) Inventors: Jasper Newton Keith, III, Lilburn; William L Gunn, Atlanta; W. Chris Morgan, Blairsville, all of GA (US)

(73) Assignee: Brink's Incorporated, Darien, CT (US)

( * ) Notice: Subject to any disclaimer, the term of this patent is extended or adjusted under 35 U.S.C. 154(b) by 0 days.

(21) Appl. No.: 09/150,115

(22) Filed: Sep. 9, 1998

(51) Int. Cl.[7] ..... G07F 11/00

(52) U.S. Cl. ..... 221/6; 221/2; 221/7; 221/14; 221/131; 221/281; 221/270; 700/236; 700/242; 700/244

(58) Field of Search ..... 221/2, 6, 7, 11, 221/14, 123, 131, 270, 274, 275, 281, 311, 312 R; 700/236, 242, 244

(56) References Cited

U.S. PATENT DOCUMENTS

| | | | | |
|---|---|---|---|---|
| 2,238,725 | * | 4/1941 | Fry | 221/270 |
| 2,638,396 | * | 5/1953 | Gabrielson | 221/6 |
| 2,843,242 | * | 7/1958 | Gabrielson et al. | 221/274 |
| 3,753,507 | * | 8/1973 | James et al. | 221/7 |
| 4,355,733 | * | 10/1982 | Schoenkopf et al. | 221/123 |
| 5,207,784 | * | 5/1993 | Schwartzandruber | 221/14 |
| 5,632,408 | * | 5/1997 | Mitchell | 221/131 |
| 5,899,358 | * | 5/1999 | Daumueller | 221/2 |
| 5,938,072 | * | 8/1999 | Lamoureux et al. | 221/7 |

FOREIGN PATENT DOCUMENTS

| | | | | |
|---|---|---|---|---|
| 2237562 | * | 5/1991 | (GB) | 221/2 |
| 0132590 | * | 5/1990 | (JP) | 221/281 |
| 0224197 | * | 9/1990 | (JP) | 221/281 |
| 404102189A | * | 4/1992 | (JP) | 221/6 |

* cited by examiner

*Primary Examiner*—H. Grant Skaggs
(74) *Attorney, Agent, or Firm*—Kilpatrick Stockton

(57) ABSTRACT

Change dispensing apparatus having multiple columns for storing and vending tubes containing change in coin or in currency. The denominations being vended by a particular machine, the unit value of that denomination, and the value of a tube containing a predetermined quantity of that denomination, are user-programmable for each machine, and any combination of denominations can be user-assigned to the columns. The tube locations in each column are monitored to detect tubes in each column, providing a running indication of the amount of change remaining for each denomination in the safe, and for the total value of change in the safe. An ejector is positionable at the lower end of each column and contains a member for selectably extracting the lowermost tube in each column. The change safe on request prints reports of change usage and other factors associated with the safe, and also predicts the amount of change required for future usage.

18 Claims, 15 Drawing Sheets

SAFE FOR HOLDING AND DISPENSING CHANGE

FIELD OF THE INVENTION

This invention relates in general to safes, and relates in particular to safes for receiving supplies of change and dispensing predetermined amounts of that change on request.

BACKGROUND OF THE INVENTION

Cashiers and clerks at retail sales locations need a ready and convenient supply of change on hand at all times. "Change" as used herein is not limited to coins, but also includes bills of denominations sufficient to meet change-making requirements for the particular business. Failure to maintain adequate change at a cash register or the cash drawer of a point-of-sale terminal may at times delay completing retail transactions while the cashier obtains a new supply of change, a practice which may reduce the total volume of sales and irritate customers who must wait while the cashier or a supervisor delivers change from a locked safe or some other secure location.

The requirement for maintaining an adequate and convenient supply of change is particularly important in certain kinds of retail sales locations such as convenience stores and gas stations, where the amount of each transaction may be relatively low and cash frequently is tendered to pay the transaction. Moreover, some suppliers of merchandise for convenience stores traditionally require payment in cash on delivery of the merchandise, and those cash payments will further deplete the amount of money remaining in the cash register or point-of-sale terminal drawer for making change.

Safes intended for storing and dispensing change are known in the prior art. Such safes heretofore have been relatively complex in construction and may lack the flexibility of storing and dispensing change of varying amounts and capacities. Moreover, such change-holding safes of the prior art lack the accounting and audit capabilities desirable to identify amounts of change dispensed and to audit the amounts remaining in the safes. Such known change dispensing safes also lack provisions for temporarily storing and accounting for deliveries of change by an armored-car messenger or other service, so that the change is at hand but remains secured within the safe itself.

SUMMARY OF THE INVENTION

Stated in general terms, a change safe according to the present invention has a plurality of columns, each column receiving several units of change so that each unit occupies a predetermined location in the column. The change safe detects the level of units in each column, so that the amount of change in each available denomination is always known. The actual change, whether a predetermined number of wrapped coins or of paper currency, preferably is loaded in cylindrical tubes of predetermined configuration, so that the dispensing mechanism and sensing elements always act on articles of the same predetermined size and shape. The present apparatus on demand vends individual units that contain selected variable amounts of coin or currency so that each tube in each column contains a known amount of change. The denominations of coin or currency in the tubes loaded into each column and dispensed from those columns, and various parameters relating to permitted vending operation for each denomination, are selectable by the user of the safe, providing flexibility for conforming the use of the present safe to the needs of different locations in which the safe is used.

Stated somewhat more particularly, sensors are associated with each column detect the tubes at the predetermined locations in the columns. Those sensors determine at all times the number of tubes remaining in the safe for dispensing. In the disclosed embodiment of the safe, tubes are dispensed from the lowermost location of each column, and the tube-dispensing mechanism is selectively operable to determine whether an article is present at that location, so that no article-detecting sensor is required for the lowermost location in each column.

Stated in somewhat more detail, the article dispensing mechanism includes an element moveable in a first direction to withdraw the lowermost article from a selected column, thereby dispensing that article from the safe. However, that displacement element is selectably operative to move in a second direction which engages the lowermost article and attempts to displace that article in a direction along which movement is blocked. If an article is present in the lowermost location, that blocked movement of the displacement element in the second direction is detected so that the displacement element indicates the presence of an article at that location. However, if the displacement element moves in the second direction without hindrance, that movement indicates the absence of an article at the lowermost location, corresponding to a condition in which the particular column contains no article to be dispensed.

The article dispensing apparatus includes a displacement element moveable on an orbital path that includes the position occupied by the lowermost article present in a selected column. However, the lowermost article is moveable from that position only in a first direction of movement of the displacement element, namely, the direction to dispense that article from the column. When the displacement element is operated to move in the opposite direction along the orbital path, the lowermost article (if present) prevents the displacement element from completing that commanded movement, and that blocked movement is detected to indicate that an article is present at the lowermost location of the particular column.

The moveable displacement element is mounted on a carriage that traverses to juxtapose the displacement element with the lowermost location of each selected column in the change-dispensing apparatus. The apparatus responds to a request for change of a particular denomination by traversing the carriage as necessary to align the displacement element with a column holding at least one tube containing change of that denomination, and then operates the displacement element to dispense the selected number of articles from that particular column, whereupon the cashier or other person using the apparatus can retrieve the dispensed tube. A sensor detects the presence of each article being dispensed, to verify the act of dispensing an actual physical article in response to the dispensing command.

Tubes are loaded into the columns through separate loading ports at the upper ends of the columns. The loading ports normally are closed by an element that blocks access to the columns, except when change-holding tubes are being loaded into the columns. The control mechanism associated with the change safe selectively unlocks the blocker door, allowing an operator to shift that blocker door to a position opening the ports for loading tubes into the columns. The position of the blocker door is sensed, so that the control mechanism associated with the change safe can provide appropriate operator prompts to close that door after loading a supply of the tubes into one or more columns.

The upper end of each column preferably includes apparatus that prevents each newly-inserted tube from dropping into the column until that tube is completely inserted through the loading port into the column. This arrangement prevents newly-inserted tubes from descending nose-first into a column, which might jam a subsequent dispensing effort and would produce a false indication of the quantity of tubes loaded into the column. The lower end of each column preferably has a joggle or similar provision for contacting the first tube dropped into an empty column, so as to break the fall of that tube and prevent the falling tube from bouncing out of position when hitting the bottom of the column.

The change dispensing safe according to the present invention also permits selective programming of each column for the denomination of change to be dispensed, and other column-specific variables such as time-of-day use restrictions, maximum number of tubes permitted per dispensing operation, whether prepayment is required from a cash drawer before dispensing change is permitted, and the like. The present safe also monitors patterns of change usage, and uses the information so obtained to forecast amounts of change required for deliveries of change at various times to the particular change safe.

The present safe also includes a separate lockable compartment intended for receiving deliveries of change from an outside source such as an armored-car service or the like. Access to that separate compartment may be limited to supervisory personnel by requiring a particular access code. The operation of the present safe also permits removing quantities of coins from the separate compartment either for loading into the individual change-dispensing columns or into a reserve location within the main compartment of the safe.

Accordingly, it is an object of the present invention to provide an improved apparatus and method for receiving and dispensing change.

It is another object of the invention to provide a change-dispensing apparatus and method offering improved flexibility of operation.

It is a further object of the present invention to provide a change-dispensing apparatus and method in which the denominations of change and other parameters for individual change-vending column areas are selectably and individually programmable by the user of the apparatus.

It is a further object of the present invention to provide a change safe intended for use with a secure depository such as a drop safe used for temporary storage of currency at retail outlets or the like.

Other objects and advantages of the present invention will become more readily apparent from the following description of a preferred embodiment.

DETAILED DESCRIPTION OF PREFERRED EMBODIMENT

Figure 1:
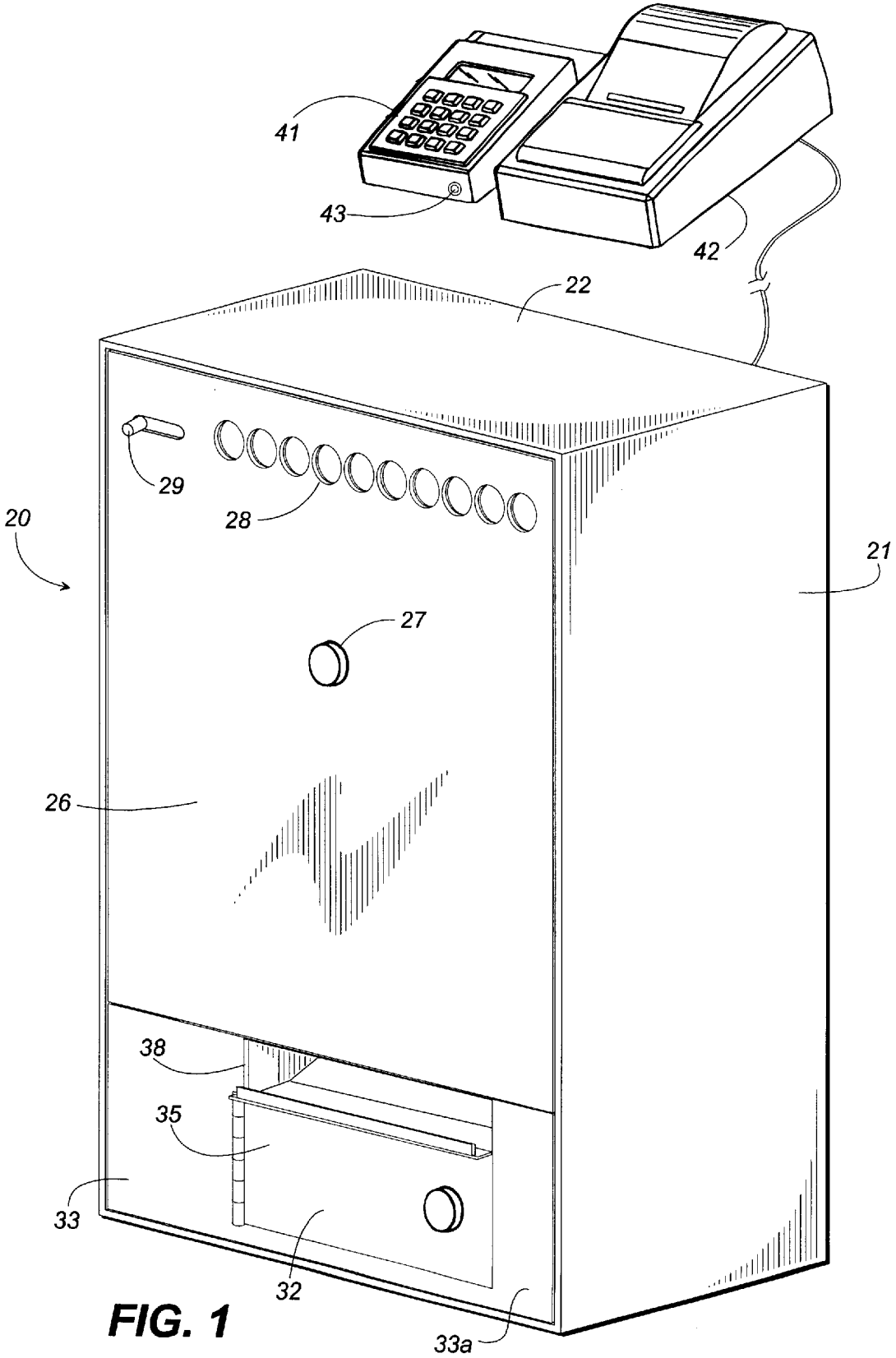
FIG. 1 is a pictorial view of a change safe according to a preferred embodiment of the invention.
Figure 2:
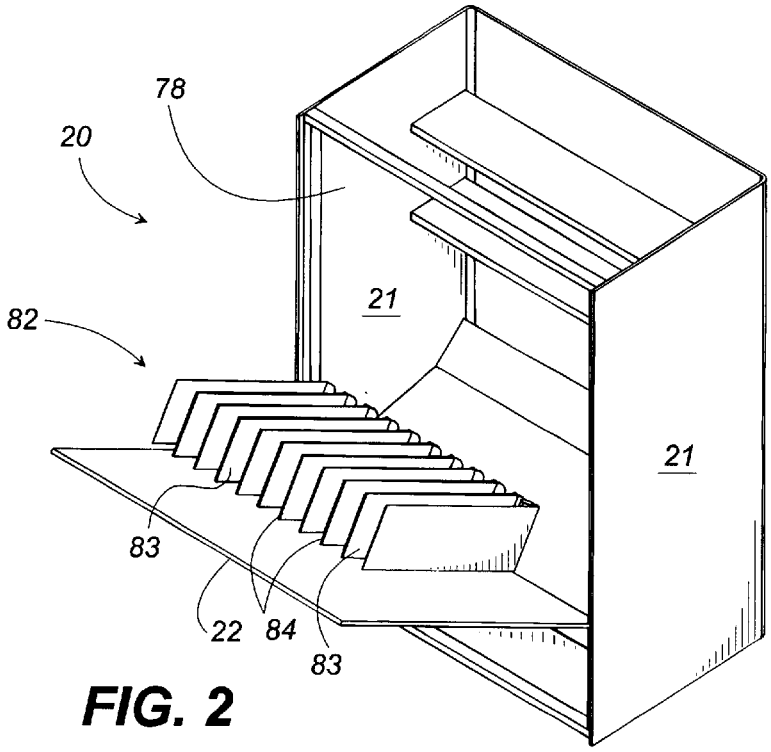
FIG. 2 is a semischematic pictorial view of the change safe shown in FIG. 1, with the upper door open for illustrative purposes.
Figure 6:
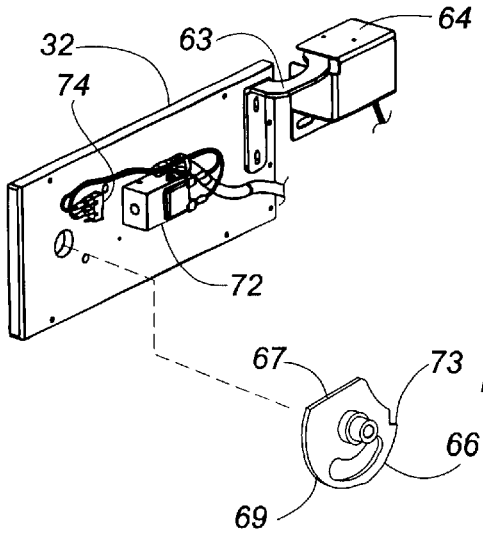
FIG. 6 is a detailed view showing the interior of the lower door in the change safe of FIG. 1.

FIGS. 1 and 2 show generally at 20 a safe for holding and dispensing change according to a preferred embodiment of the present invention. The safe 20 is defined in part by side walls 21, a top panel 22, a bottom panel 23 (FIG. 3), and a back panel 24 assembled to define the generally boxed-shaped safe 20. The various panels comprising the outer perimeter of the safe 20 preferably are made of steel or another metal of strength and construction sufficient to withstand at least moderate attempts to force open the change safe.

The front of the safe includes an upper door 26 hinged along the bottom to open by swinging outwardly, as shown in FIG. 2. A knob 27 is located on the exterior of the upper door 26 and is connected to actuate a bolt mechanism within the safe, as described below. A number of separate ports 28 are horizontally aligned near the upper edge of the door 26, for selectively loading change holders into corresponding receptacles within the safe. The ports 28 are selectively blocked or unblocked in unison by a slideable blocker plate located behind the upper door 26 and manipulated by the handle 29 extending through a slot to the left of the ports. As explained below, the blocker associated with the ports 28 normally is locked in the closed position by apparatus within the change safe, preventing anyone from tampering with the safe through the ports.

The change safe 20 also has a lower door 32 mounted in a panel 33 located below the upper door 26. The lower door 32 swings open along a hinge at the left side of that door, providing access to a lower storage compartment 34 (FIG. 3) within the change safe. A knob 35 on the lower door 32 actuates an internal locking mechanism for that door, as described below.

The exit of change delivery chute 38 is located on the front panel 33 between the lower door 32 and the bottom of the upper door 26. Tubes or other articles dispensed from within the change safe drop by gravity to the outer end of the chute 38, where a cashier or other person may retrieve the articles for use.

The various mechanical and functional operations of the present change safe are controlled by a programmable microprocessor 40, as is described below in greater detail. That processor is associated with a control terminal 41 for entering commands into the safe and displaying messages, and with a printer 42 for printing various reports relating to the operation and contents of the change safe. In a preferred application of the present change safe, that safe is intended for installation and operation in conjunction with a drop safe of a kind disclosed in U.S. Pat. No. 5,695,038, the disclosure of which is incorporated herein by this reference thereto. That drop safe operates under programmed control, and incorporates a data terminal and a printer, and the change safe described herein preferably is connected to the control processor of the drop safe and shares the microprocessor, the data terminal, and the printer associated with the drop safe. It should thus be understood that the control terminal 41 and printer 42 described herein may advantageously be associated with a drop safe as referenced herein, so that only a single data terminal, printer, and programmed processor are required to operate the present change safe and the drop safe as described in U.S. Pat. No. 5,695,038. This common control of both the drop safe and the change safe afford several operational advantages as described below. Of course, it should be apparent to those skilled in the art that the present change safe may alternatively be operated as a free-standing unit equipped with its own control processor, data terminal, and printer, to operate as described herein independently of any other apparatus.

Figure 3:
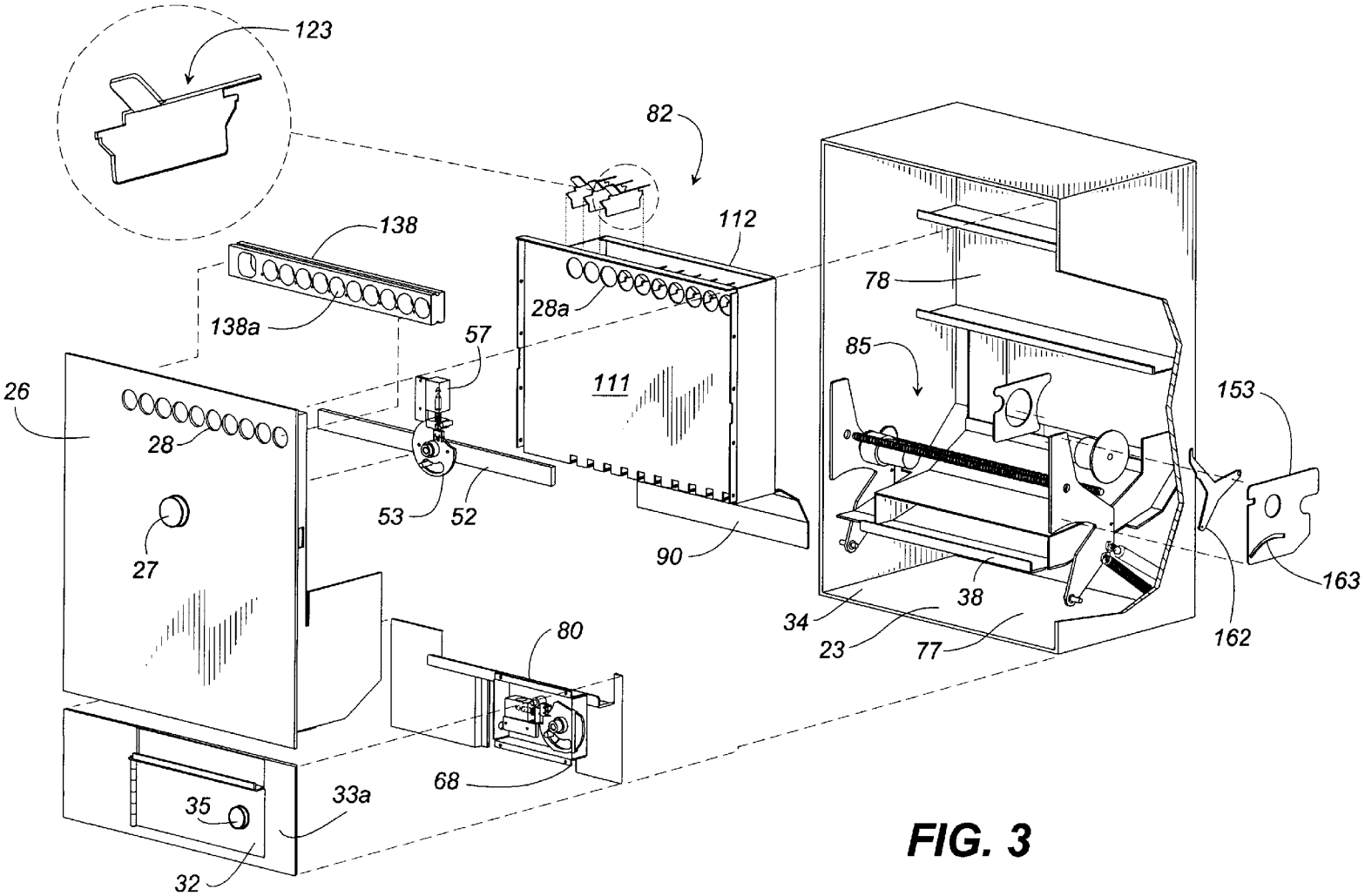
FIG. 3 is an exploded pictorial view of the change safe shown in FIG. 1.
Figure 7:
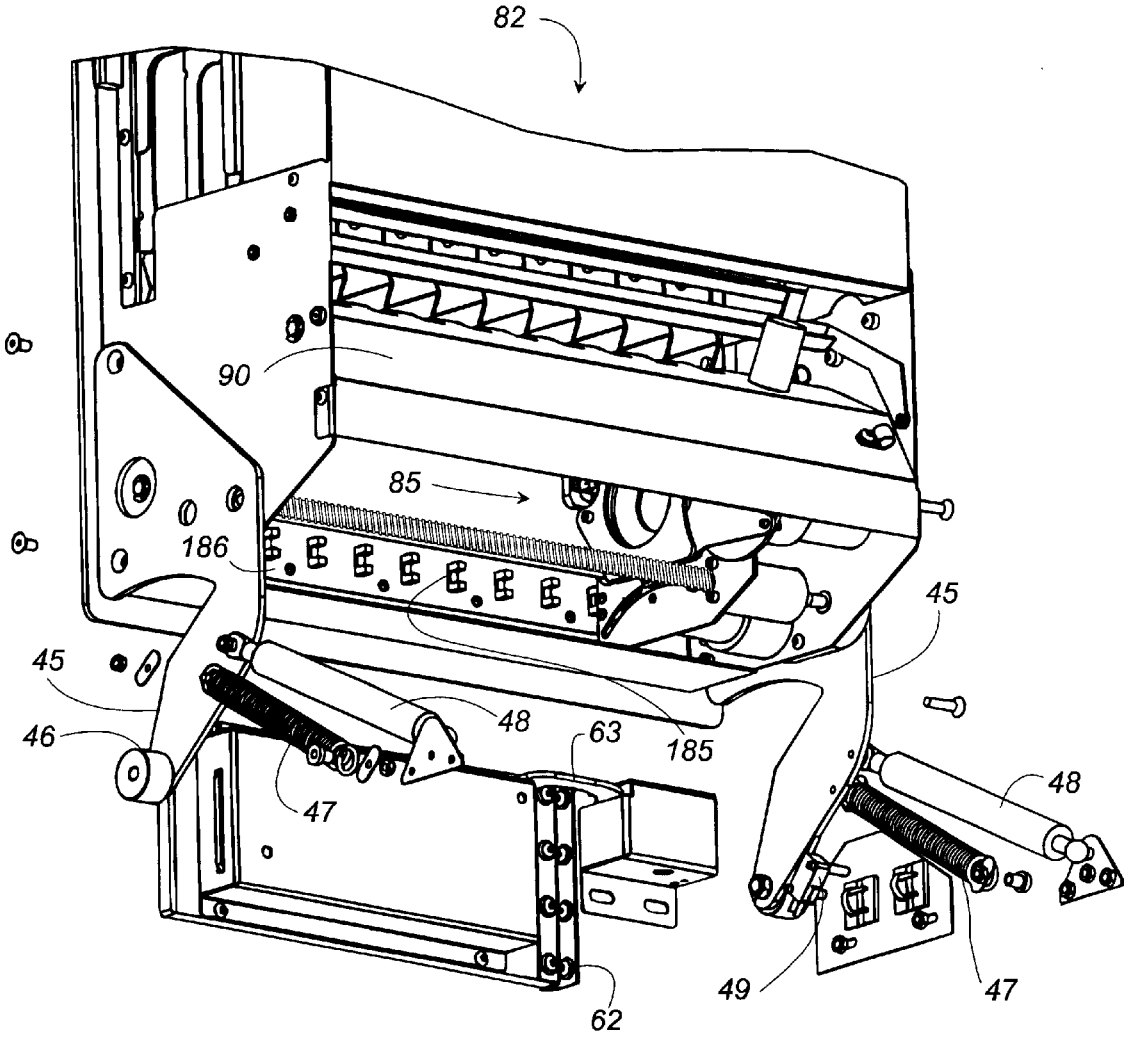
FIG. 7 is a pictorial view showing rear details of the upper and lower doors, the change dispensing subassembly, and related structure of the change safe shown in FIG. 1.

FIGS. 2, 3, and 7 show interior views of the change safe 20. The upper door 26 is mounted on supports 45 having lower ends pivotally connected at 46 to suitable structure on the inside of the safe 20. Tension springs 47 attach between the supports 45 and the side walls 21 of the safe to exert a counterbalancing force urging the upper door 26 closed, and buffer cylinders 48 extend in parallel with the springs to inhibit abrupt movement of the upper door when opening or closing that door. The springs 47 and buffers 48 help overcome the significant combined weight of the upper door and the change dispensing subassembly 82 (including coins loaded therein) carried by that door, thereby reducing the risk of personal injury resulting from sudden or uncontrolled movement when the upper door is unlocked.

A switch 49 (FIG. 7) is mounted adjacent one of the supports 45 for the upper door 26. The switch 49 changes state whenever the upper door is moved from its fully-closed position as illustrated in FIG. 1 and sends that status to the microprocessor 40.

The upper door 26 is locked in the closed position by a pair of bolts 52 mounted on the inside of the upper door, each having an inner end connected to the lock cam 53. The outer ends of the bolts 52 are slideably mounted in openings at the sides 54 of the upper door. The lock cam 53 connects to a cam shaft (not shown) extending through the upper door 26 and connecting to the knob 27 on the front of the upper door. Rotating the knob 27 in either direction thus turns the lock cam 53 through a degree of rotation selectively extending the bolts 52 into mating recesses supported by side walls 21 of the safe on either side of the upper door 26, or withdraws the bolts from those recesses.

Rotation of the lock cam 53 is selectably blocked or enabled by the upper-door solenoid 57, having a spring-biased plunger that engages a mating recess in the lock cam 53 when the bolts 52 are extended to lock the upper door. The knob 27 thus cannot turn the lock cam 53 to withdraw the bolts and unlock the upper door unless the upper-door solenoid 57 is energized to withdraw the locking plunger from the lock cam 53. A switch 59 is mounted adjacent the upper-door solenoid 57 to detect movement of the solenoid plunger to the unlocked position, so that the switch indicates when the upper-door locking mechanism is enabled to unlock that door whether or not the knob 27 has been manipulated to draw the bolts 52.

The lower door 32 is connected to the change safe by a hinge 62 along the left side of the door. As best seen in FIG. 7, an arm 63 connects to the inside of the lower door and actuates the lower-door switch 64 mounted on the inside of the front panel 33. The lower-door switch 64 indicates whether or not the lower door is fully closed.

The locking mechanism for the lower door 32 includes a locking cam 66 on the inside of the lower door, connected by a shaft (not shown) to the knob 35 on the front of that door. The locking cam 66 is mounted in spaced-apart relation to the back of the lower door, and that locking cam includes a cut-away portion 67 providing clearance for the plate 68, FIG. 3, immediately behind the front panel portion 33*a* at the right of the lower door. When the lower door 32 is closed, the plate 68 is positioned between the back side of the lower door and the portion 69 of the lock cam 66 that is not cut away. Rotating the lock cam 66 with the lower door closed, thus positions that portion of the lock cam 66 behind the plate 68, thereby locking the lower door closed.

A lower-door solenoid 72 is mounted on the back of the lower door 32 and has a spring-loaded plunger urged against the periphery of the lock cam 66. That solenoid plunger engages a notch on the periphery of the lock cam 66 when the lock cam is positioned to lock the lower door, so that the lower door remains locked unless the lower-door solenoid 72 is energized. A switch 74 is mounted to sense the position of the plunger for the lower-door solenoid 72, so that the switch indicates an unlocked condition of the lower door whether or not that door is open.

The lower door 32 opens to access the lower compartment 34 within the change safe. This lower compartment is available for short-term storage of change delivered by an armored-car service, for example, before accounting for the change within the change safe and adding that change to the dispensing columns or to the reserve location 78 (FIGS. 2 and 3) located in an upper portion of the change safe, behind the upper door 26. The lock mechanism for the lower door 32 preferably is enclosed within a housing 80 mounted on the inside of the lower door, to protect that mechanism from contacting bags of change or other items placed within the lower compartment 34.

A change dispensing subassembly indicated generally at 82 is mounted on the inside of the upper door 26 and moves outwardly with the upper door as that door is opened. The change dispensing subassembly includes a plurality of adjacent spaced-apart vertical partitions 84 defining vertical columns 83, with the upper end of each column being juxtaposed with corresponding ones of the loading ports 28 formed in the upper door 26. The dispensing subassembly 82 also includes an article ejector subassembly 85 mounted below the array of columns 83, and selectably operative to eject a change tube or other article from any selected column. These two subassemblies are described below.

The partitions 84 defining the columns 83 extend upwardly from lower ends adjoining the substantially horizontal surface 89 of a plate 90 extending beneath the partitions. The horizontal portion 89 of the plate forms the bottom 92 of each column 83 and supports the tube at the lowermost position of each column. A slot 93 is formed in each bottom 92 and extends substantially the entire front-back dimension of the bottom. These slots accommodate the ejector member of the ejector subassembly 85, as described below.

Figure 4:
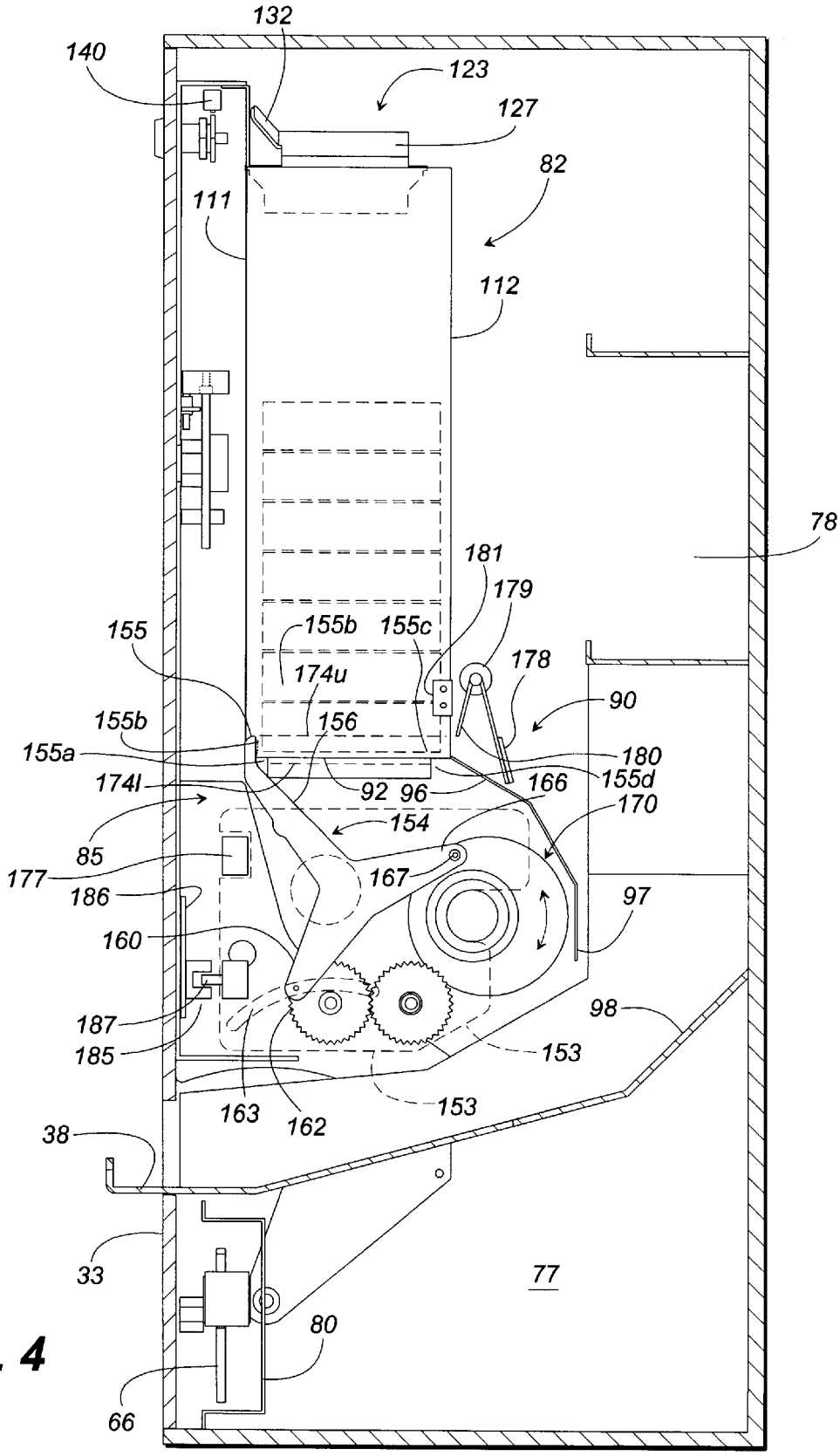
FIG. 4 is a partially-sectioned side elevation view of the change safe shown in FIG. 1.

The plate 90 includes a downwardly-bent portion 96 extending rearwardly from the slotted bottom surface 92. That downwardly-bent portion in turn leads to a substantially vertical portion that extends around the back of the traversable ejector assembly 85 as best seen in FIG. 4 and ends a short distance above the inner end 98 of the dispensing chute 38. As will be seen, tubes dispensed rearwardly from the columns 83 fall along the portion 96 of the plate 90 to land on the inner end 98 of the dispensing chute 38, from which those tubes descend by gravity to the exit end of the chute.

As mentioned above, the preferred embodiment of the present change safe stores and dispenses change contained in cylindrical tubes 102 of predetermined length and diameter. Each such tube typically contains a conventional roll of coins or rolled-up paper money of predetermined denomination and total value. The tubes preferably are made of a rigid material such as plastic or the like, which maintains the predetermined shape of tubes during a vending operation. (It should be understood that items other than money may be contained in the tubes and dispensed by the present apparatus.)

Figure 8:
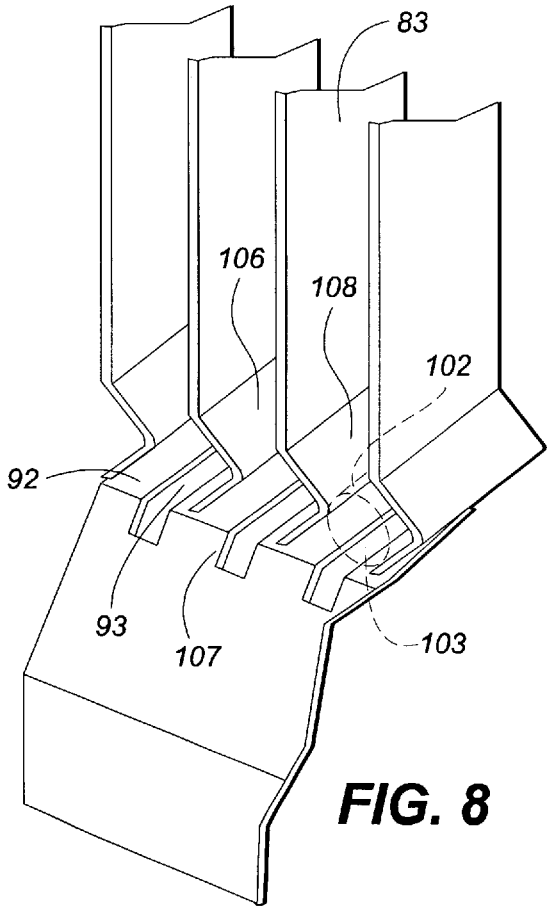
FIG. 8 is a detailed pictorial view showing the lower end of several columns for holding tubes of change in the change safe of FIG. 1.

One such tube 102 is shown at FIG. 8 located at the bottom of a column 83. The view in that figure is taken from the back of the change dispensing subassembly 82, showing the flat end 103 of the tube 102. The closure at the opposite end of the tube is inset from that end, so that the circumference of the tube forms an annular ring at that opposite end.

The adjacent partitions 84 forming each column 83 are mutually spaced apart a distance slightly greater than the diameter of the tubes 102, so that the tubes will readily fall by gravity when inserted into the upper ends of the columns as described below. Each partition near its lower end is bent to form a joggle 106, with the joggles having approximately the shape of a broad sideways-V extending from the front to the back of each partition. As best seen in FIG. 8, the peak 107 of the joggle 106 in each partition faces, in spaced-apart complementary fashion, the valley 108 of the joggle in the adjacent partition. These peaks and valleys are spaced above the bottom surface 92 of each column 83 approximately one-half the diameter of the tubes 102, although that exact spacing is not considered critical. The confronting peak 107 and valley 108 of the joggles in each column locate the lowermost tube 102 in predetermined position on the bottom surface 92, with the lower side of the horizontal cylindrical tube resting on the slot 93 in the bottom surface of that column. Furthermore, the joggles 106 intercept and break the fall of the first tube 102 dropped into an empty column 83, reducing the velocity of the tube just before striking the bottom surface 92 of the column and thus reducing the likelihood that the lowermost tube will bounce when dropped onto the bottom surface and become improperly located, leading to problems in a subsequent vending operation.

Figure 9:
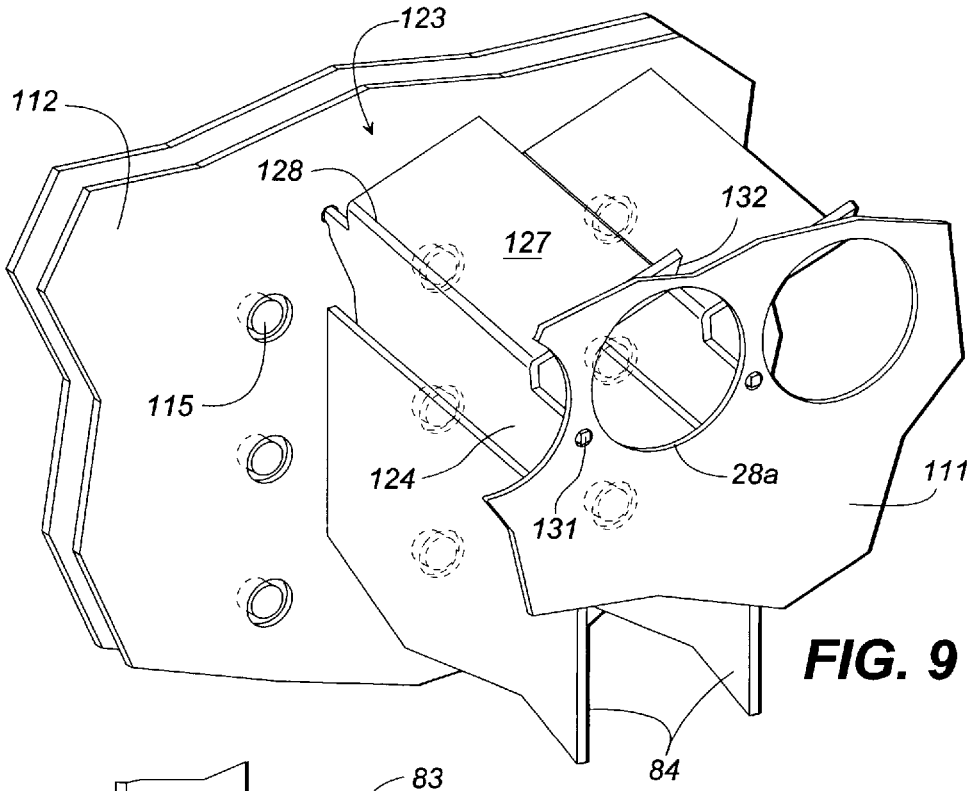
FIG. 9 is a detailed pictorial view showing the upper end of several such columns including the tube flaps.

The columns 83 are further defined by the front plate 111 and back plate 112, best seen in FIGS. 4 and 9. The back plate 112 supports a sensor board assembly having vertical arrays of photosensors 115 mounted on the back plate 112 in alignment with the columns 83 between the back and front plates. Each photosensor 115 on the back plate 112 is aligned with the predetermined vertical location of a tube 102 loaded into the columns. The presence of a tube 102 at a particular vertical location, e.g., three tubes up from the bottom of the column, thus is positively detected by the sensor 115 at that particular vertical location in the particular column. This arrangement provides a rapid inventory of the physical contents in each column 83 of the change safe.

Because the ejector subassembly 85 traverses the lowermost locations of the columns 83, it is not practical to include a photosensor for those lowermost locations. Thus, the number of photosensors 115 mounted for each column on the back plate is one less than the total capacity for tubes in each column. In an actual embodiment of the present change safe, each column holds a maximum of ten tubes and the columns thus each have nine photosensors 115 on the back plate 112.

The presence of a tube 102 at the lowermost location in a column is implied if the photosensor for at least the next vertical location in that column detects a tube. However, a positive check for a lowermost tube in each column also is available as disclosed below.

Figure 10:
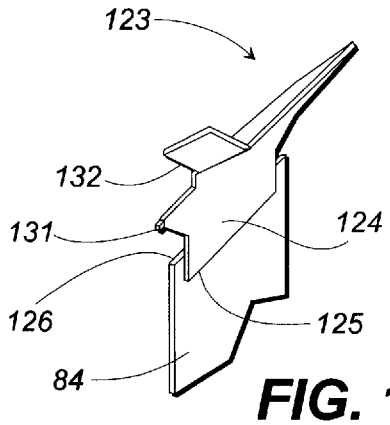
FIG. 10 shows a typical tube flap in relation to the wall of a tube column.

Tube flaps shown generally at 123 in FIGS. 9 and 10 are positioned at the upper end of each column 83 in substantially horizontal alignment with corresponding ports 28 in the front of the safe 20. Each tube flap 123 is engaged when a tube 102 is first inserted into a port 28 and an aligned port **28*a* in the front plate 111, and the tube flap 123 prevents a tube from dropping into the corresponding column 83** until the tube is substantially completely inserted through the port.

Each tube flap 123 extends generally from front to back at the top of a corresponding column and is mounted for pivoting movement on a horizontal axis 131. The tube flaps 123 each have a floor plate 124 whose lower edge 125 overlaps and extends slightly below the upper edge 126 of the partition 84 defining one side of the column. The opposite edge of the floor plate 124 joins an upper plate 127 along a bend line 128 extending the length of the tube flap. The bend line 128 is located a short distance beyond the horizontal axis 131 of rotation, on which the tube flap 123 is mounted within the change dispensing subassembly 82.

A guide tab 132 extends outwardly and forwardly from the front edge of the upper plate 127. The guide tab 132 of each tube flap 123 is positioned immediately behind the corresponding tube-loading port 28, so that the flat end 103 of a tube immediately contacts the guide tab as the tube is initially inserted through the port. That contact with the guide tab causes the tube flap 123 to rotate counter-clockwise (as seen in FIG. 9 on the axis 131, thereby raising the floor plate 124 to partially block the upper end of the column 83. Continued insertion of the tube 102 through the port 28 slides that tube across the floor plate 124, so that the tube flap 123 temporarily supports the tube. Once the tube 102 is completely inserted through the loading port **28*a* so that the trailing end of the tube moves past the edge of the loading port, the tube flap 123 is free to pivot downwardly about the axis 131 to the initial position shown in FIG. 9** wherein the floor plate 124 returns to engage the upper edge 126 of the partition 84. That pivoting movement removes the floor plate 124 from its temporary position blocking the upper end of the column 83, allowing the just-inserted tube 102 to drop within the column until that tube contacts the lowermost end of the column or the last tube previously loaded into the column. In either case, the just-inserted tube cannot fall within the column until substantially fully inserted into the column, thereby preventing the tube from falling head-first into the column after the tube is only partially inserted through the loading port 28.

As previously mentioned, the tube loading ports 28 are selectably closed by a blocker door to prevent unauthorized access to the columns 83. This blocking is accomplished by the tube blocker 138 (FIGS. 3 and 5) in the form of a horizontal plate extending immediately behind the ports 28 through the upper door 26 of the safe. The actuating handle 29 (FIG. 1) extends forwardly from one end of the tube blocker 38 and projects through the elongated slot in the top door, for manual manipulation of the tube blocker. The tube blocker has an array of ports 138*a* conforming in size and number to the ports 28 in the upper door, and the blocker ports 138*a* either are coaxial with the door ports 28 or are laterally offset to obstruct the door ports, depending on the longitudinal position to which the tube blocker 138 is moved.

A solenoid 140 (FIG. 4) is located in relation to the tube blocker 138 so that the spring-biased armature of the solenoid engages and locks the tube blocker in position blocking the ports 28 through the upper door of the change safe. The tube blocker 138 is enabled for sliding movement, in response to the handle 29, only when the solenoid 140 is operated. A switch 142 is located adjacent the tube blocker 138 to detect the open vs. closed position of the tube blocker.

Figure 5:
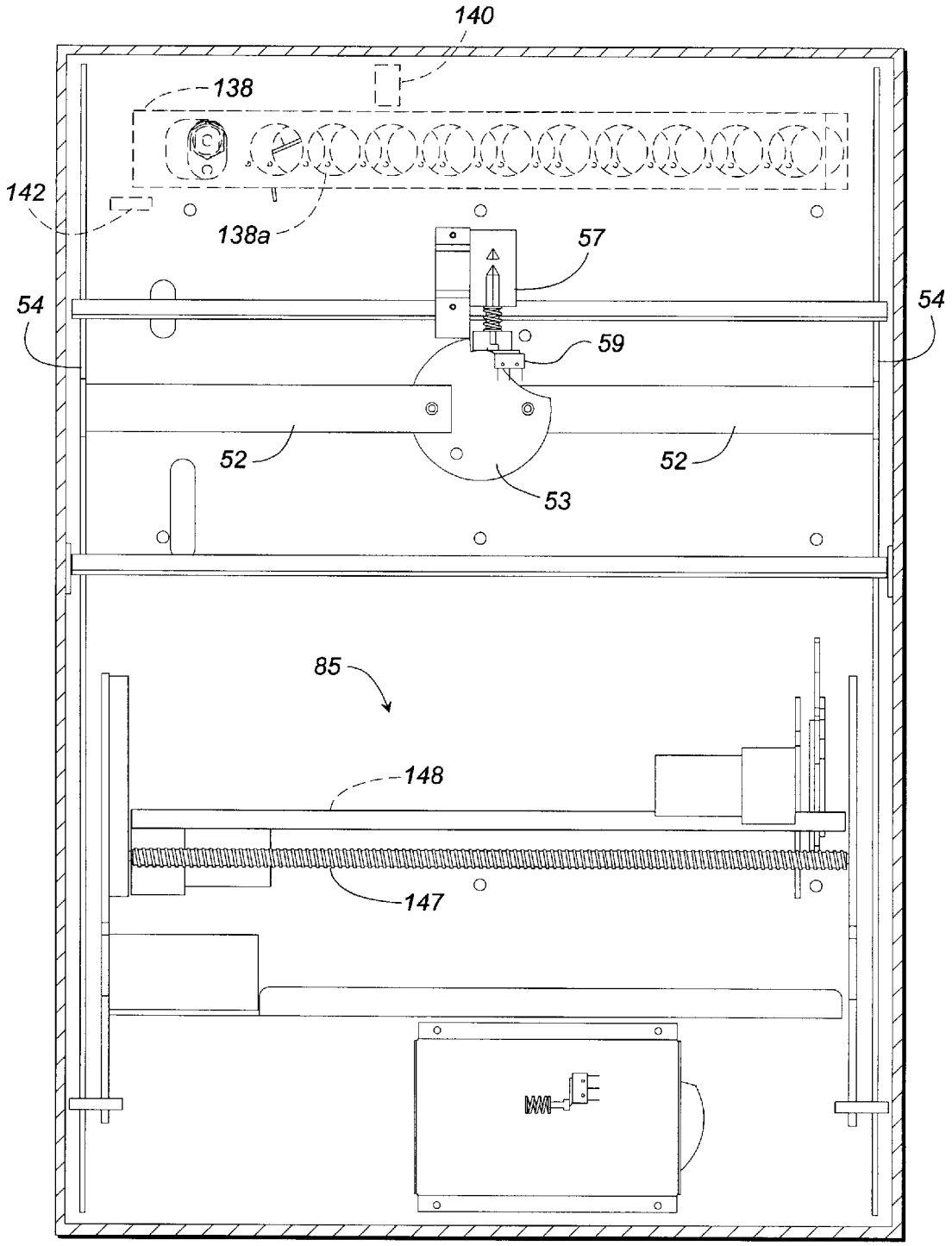
FIG. 5 is a front elevation view, partially-sectioned and broken away, showing details of the upper-door lock mechanism, the blocker door for loading tubes into the columns, and other details of the change safe shown in FIG. 1.

The change ejector subassembly 85 is best understood with regard to FIGS. 4, 5, and 7 That subassembly is mounted beneath the change dispensing subassembly 82 for selective positioning beneath any column 83 and operates to eject the lowermost tube 102 from that selected column. The carriage 146 is supported by a threaded horizontal lead screw 147 and a parallel, smooth rod 148 extending horizontally beneath the change dispensing subassembly 82. A lead screw drive mechanism including a stepper motor 150 is located at one end of the lead screw 147 and selectably rotates the lead screw in either direction. The lead screw 147 engages a nut or the like associated with the carriage 146, so that the carriage is traversed in either direction along the lead screw and the rod 148 depending on the rotational direction of the rotor 150.

The carriage 146 has at one side an extractor plate 153 (FIGS. 3 and 4) that in part defines the path of movement of the extractor 154, which engages and removes a change tube 102 from the lowermost location in a selected column 83. The extractor 154, shown in detail in FIG. 4, is somewhat Y-shaped and has an extractor finger 155 protruding upwardly from an outer end of a first arm 156 which extends from the central body portion 157 of the extractor. A second arm 160 extends downwardly from the central body portion 157 to an outer end 161, from which extends a transverse pin 162 slideably engaged in the curved slot 163 formed near the lower edge of the extractor plate 153.

A third arm 166 of the extractor 154 extends forwardly and upwardly from the central body portion 157 in a somewhat-symmetric relation to the second arm 160. A roller pin 167 is rotatably attached near one end of the second arm 166 and attaches to the wheel 170 mounted in the carriage 146 parallel to the extractor plate 153. An ejector stepper motor 171 mounted with the carriage 146 is coupled to the wheel 170 and selectably rotates that wheel in either direction.

The geometry of the extractor 154, constrained in movement by the pin 162 traveling in the slot 163 of the extractor plate 153, and by the circular path of the roller pin 167 connected to the wheel 170, constrains the extractor finger 155 to traverse a closed path somewhat resembling a horizontally-elongated O. The path is parallel to the slot 93 at the bottom 92 of the column 83 beneath which the carriage 146 is positioned. The path 174 has an upper portion 174*u* extending through the slot 93 into the lowermost tube position within that column, and a parallel lower portion 174*l* extending a distance below that slot and thus out of the lower-most tube position within the column.

Movement of the extractor 154 starts from a home position wherein the second arm 160 of the extractor is at its maximum leftward position and the extractor finger 155 is at the position 155*a* near the bottom-left end of the lower portion 174*l* of the traverse path. This home position of the extractor 154 is detected by the sensor 177, mounted for actuation by the extractor in that home position. Assuming the stepper motor 171 drives the wheel 170 in the clockwise position as viewed in FIG. 4, the wheel begins raising the outer end of the third arm 166 while simultaneously moving the second arm 160 to the right along the slot 163. Because the slot curves upwardly from its leftmost end, these movements elevate the first arm 156 and raise the extractor finger along the path 174 to a position 155*b*, in which the extractor finger is positioned to enter the front end of the slot 93 and engage the front end of a tube 102 in the lowermost position of the column. Continued clockwise rotation of the wheel 170 moves the finger 155 along the upper path 174*u*, traversing the finger through the slot 93 and extracting the lowermost tube 102 from the column. This rearward extractive movement of the finger 155 continues until the finger reaches its rearmost position 155*c*, at which time the tube 102 has been fully extracted from the column to drop downwardly along the plate 90 and enter the chute 38 leading to the front of the change safe.

As the finger 155 extracts the tube 102 from the column, that tube encounters and displaces the tube ejection flap 178 extending across the back of the change dispensing subassembly 82 to lie immediately behind the lowermost ends of the columns 83. The tube ejection flap 178 is pivotably mounted along a horizontal hinge 179 and has an arm 180 operatively associated with a sensor 181 mounted on the change dispensing subassembly 182. The sensor 181 thus detects the actual physical ejection of a tube from any column 83, in response to a commanded extraction operation of the extractor 154.

After the extractor finger 155 reaches the position 155*c*, continued rotation of the wheel 170 draws that finger downwardly to a lower position 155*d*, beneath the rearmost position 155*c* and below the slot 93 at the lowermost end of the column. The finger 155 then moves rearwardly along the lower path 174*l* as the wheel 170 continues to rotate, until the extractor 154 arrives at the home position as determined by the sensor 177. Sensing the home position signals the microprocessor 40 to stop the ejector stepper motor 171, completing the cycle for extraction from a column, unless the operator had requested more than one tube from that column.

To provide a positive check for the presence of a tube at the lowermost location in a column, the ejector stepper motor 171 is operated in a direction opposite to the direction described above to eject a tube from the column. This opposite-direction motion moves the finger 155 in the opposite direction along the path 174 until the finger enters the backend of the slot 93. If a tube 102 is in the lowermost position of the column, the finger 155 engages the backend of that tube and attempts to move the tube forwardly, but the front plate 111 blocks that attempted forward movement. That blocked movement in the opposite direction thus indicates the presence of a tube at the lowermost location. However, if the finger 155 moves forwardly through the lowermost location without hindrance, that movement indicates the absence of a tube at the lowermost location.

A horizontal array of sensors 185 determines the proper location of the carriage 146 with respect to the columns 83 of the change dispensing subassembly. The sensors 185 are arrayed on a board 186 mounted in front of the moveable carriage, as best shown in FIGS. 4 and 7. An element 187 is mounted on the carriage 146 for movement therewith along a horizontal path intersecting each sensor 185, as the motor 150 traverses the carriage beneath the columns. The fixed sensors 185 and the moveable element 187 are positioned relative to the columns so that the sensor associated with a particular column detects the element when the carriage is positioned with the extractor 154 beneath the slot 93 for that column, signaling the microprocessor 40 to stop the carriage at that location.

Figure 11:
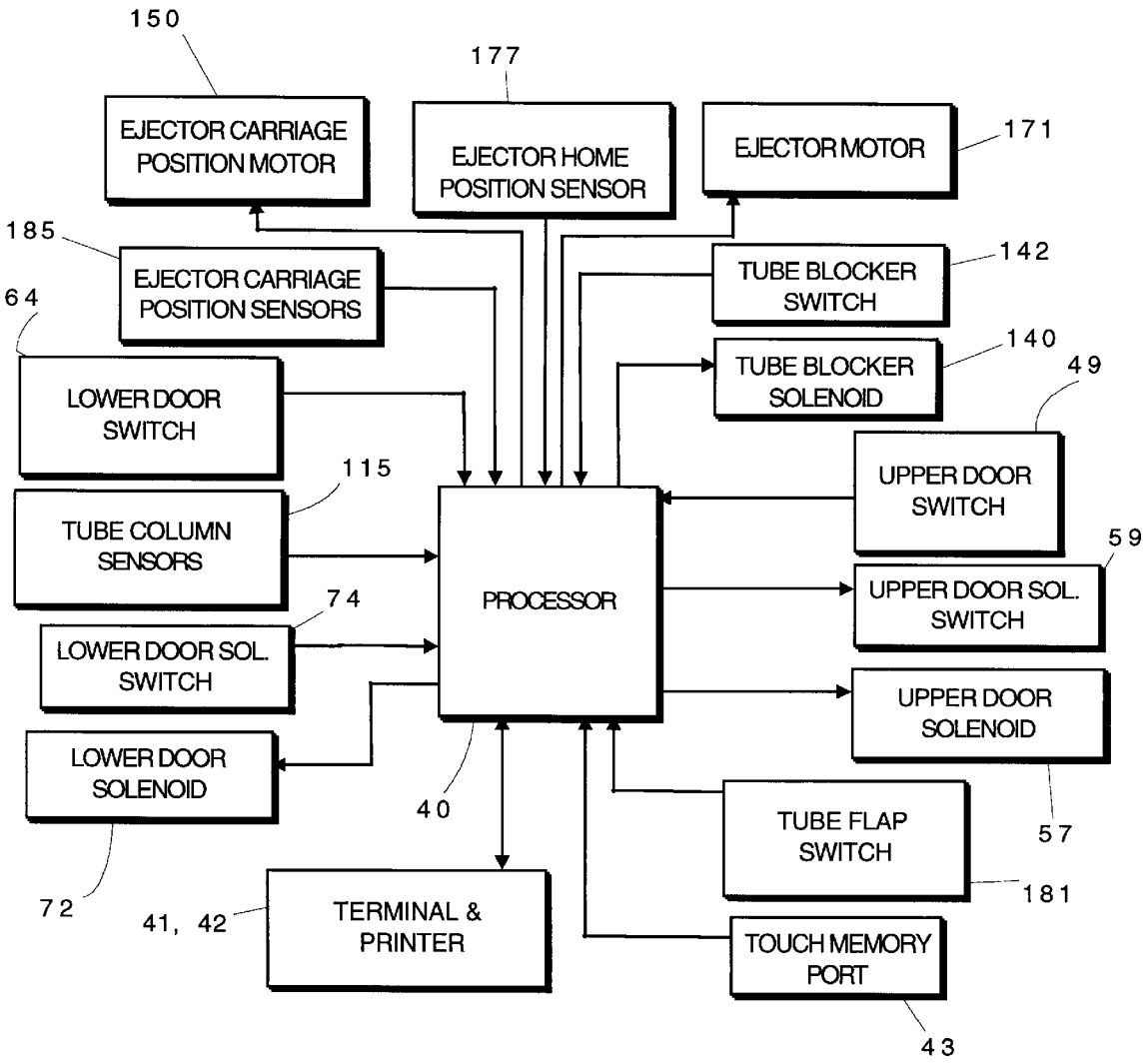
FIG. 11 is a block diagram of control apparatus for the disclosed embodiment.

The change safe preferably operates under programmed control to define denominations of change dispensed by a particular safe, varying levels of access to the safe for dispensing change, for opening the upper and lower doors to receive deliveries of change and to deposit that change into the columns of the safe, and selected other parameters. This system includes the programmable microprocessor 40, FIG. 11, programmed to function as a central processing unit (CPU) for the system. The processor includes suitable memory and other elements typically associated with such units, and is connected to receive signals from the various switches and sensors, and to deliver operating signals through appropriate drivers to the solenoids and other actuators, as disclosed herein. As mentioned above, the processor 40 may be physically located in a separate drop safe connected via a signal path to the present change safe.

In addition to the terminal and printer associated with the microprocessor, a portable microchip memory module preferably is used to input information for accessing the lower compartment of the change safe by a messenger delivering a new supply of change. For that purpose, a touch memory port 43 is connected to the microprocessor. That port interfaces with a memory module chip (not shown) carried by the armored-car messenger. Further details of such memory modules are found in the aforementioned U.S. Pat. No. 5,695,038.

Operation of the preferred embodiment is now discussed with reference to the operating menu shown in FIG. 12. Each submenu in that figure shows a principal operational feature of the change safe, and it will be understood that the microprocessor 40 is programmed to deliver appropriate operating signals and to compile and display information on the printer 42 or on a visual display associated with the terminal 41. Such programming of microprocessors is well within the skill of the art and need not be detailed herein.

A change safe according to the present invention has multiple columns 83 for receiving change, and any possible combination of certain variables can be assigned to each column. These variables for each column include the denomination of a particular unit of change (e.g., pennies, nickels, or bills such as tens or twenties) for that column, the value of each tube containing that denomination of change (e.g., pennies are $0.50 per tube) the maximum balance to maintain in the change safe for that denomination, the maximum number of tubes for that denomination to be vended at one time, whether the cashier must prepay (e.g., by inserting at least an equal value of bills in a related drop safe) to cover the change vend, whether the denomination may be vended as a cash payout (e.g., paying a vendor for C.O.D. purchases, lottery payouts, refunding customer money), whether only a supervisor may vend this denomination, the amount of time (if any) which must elapse before another vend of this denomination may be made, and any time-of-day restriction to vending the specified denomination.

Figure 12:
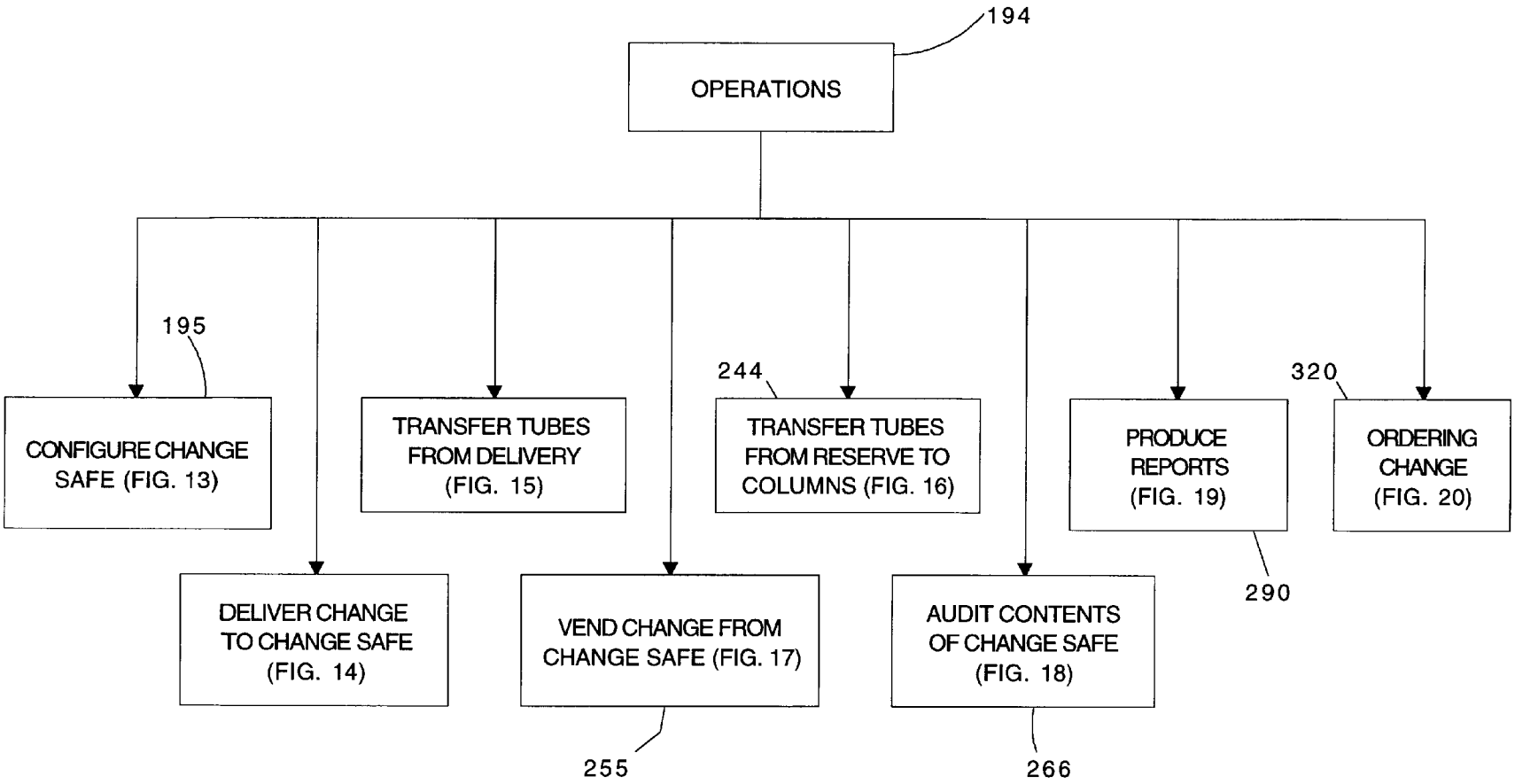
FIG. 12 is flow charts showing operation of the disclosed embodiment.

Selecting principal operations of the change safe is initiated at block 194 in FIG. 12. Configuring the change safe normally requires approval of a supervisor in the location where the safe is installed, and those skilled in the art will understand that the operation block 194 includes various introductory steps such as requiring entry at the terminal 41 of a proper Personal Identification Number (PIN) for a supervisor. Once the supervisor's pin is entered, the supervisor can elect to configure the change safe as shown in block 195 and as detailed in FIG. 13. Turning to that figure, the setup routine allows configuring either the individual columns of the change safe as shown at step 197 or the denominations intended for those columns, as shown at step 196. A new change safe according to the present invention may have all columns set to an unused status, and a display or printed report at that time will indicate "unused" as the denomination for each column. This allows a store supervisors to set up the columns in a way that best fits the operation of a particular store. A typical configuration might be:

| Column | Denomination |
|---|---|
| 1 | Pennies |
| 2 | Pennies |
| 3 | Pennies |
| 4 | Nickels |
| 5 | Nickels |
| 6 | Nickels |
| 7 | Dimes |
| 8 | Quarters |
| 9 | Ones |
| 10 | Fives |

Figure 13:
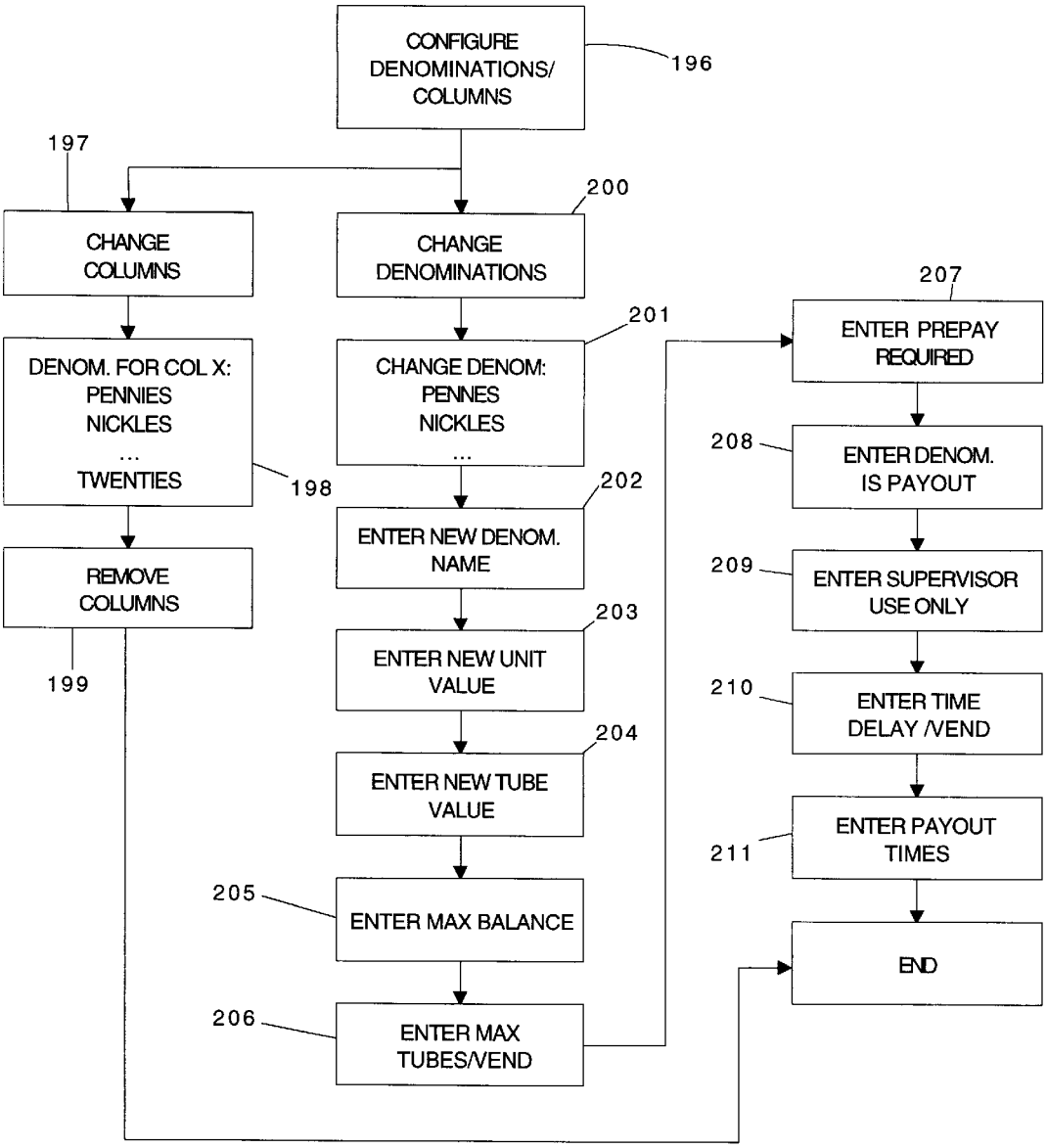
FIG. 13 is a flow chart showing configuration of the disclosed embodiment for various denominations.

This step is indicated at 198 in FIG. 13. If the supervisor desires to leave a particular column unassigned or to deselect a column previously assigned a particular denomination, that step is shown at 199 in FIG. 13. After assigning each available column of the change safe a particular denomination, the supervisor may return to the main menu to select other operations, as indicated by the "End" block in FIG. 13.

Configuring the change safe to identify possible denominations of change for vending, and to set the various attributes available for each denomination, is shown in FIG. 13 starting with the block 200. The supervisor may elect to change any denomination previously selected for the change safe, as shown at step 201. Changing denominations can include adding a new denomination, changing an existing denomination, or simply deleting an existing denomination without substituting a new one. The name of each new denomination is entered at 202, after the supervisor selects whether this denomination is new or a change of a previous one. If a new denomination, the supervisor enters its name in the terminal 41. Next, the new unit value of that denomination is entered as shown at 203. If the denomination is nickels, the unit value is $0.05; the unit value of a column being set to vend "20s" is $20.00. The cashier then enters the total value of each tube containing that denomination, as indicated at 204.

After entering the basic information for a particular denomination, the supervisor then enters the maximum balance to maintain in the safe for that particular denomination, as shown at 205, followed by the maximum number of tubes to be vended at one time for that denomination as shown at 206. If a cashier must prepay enough currency to cover a change vend for the particular denomination, this option is selected at block 207. ("Prepayment" means the cashier must transfer at least enough currency from the cash drawer to a drop safe or other depository at the store and connected to the change safe as mentioned above, before the change safe can accept a request to vend change of the particular denomination.

The supervisor also may select certain denominations for use as a cash payout, as shown at 208. This means the money in a column containing that denomination may be vended to pay for C.O.D. purchases at a store containing the change safe, for customer refunds, payout of winning lottery tickets, and so on. Typically, supervisory approval would be required for such payouts.

Any denomination can be selected for vending only with supervisory approval, i.e., by entering a supervisor's PIN. This designation is shown at block 209 and usually applies to denominations having a relatively high tube value.

The supervisor may also enter the amount of time, if any, which must elapse after vending a particular denomination, before another vend of this denomination may be made. Selecting the delay feature, and entering the amount of time which must elapse, are shown at block 210 in FIG. 13.

Lastly, for each denomination the supervisor may restrict the time during which this denomination may be vended. This restriction, shown at 211, allows entering the time of day at which the change safe can vend the specified denomination, and the time of day after which the change safe cannot vend that denomination. This step, as well as the other steps indicated from 197 through 211, is selected for each denomination to be vended for a particular change safe, and a supervisor may later change those settings for any denomination of the change safe.

Figure 14:
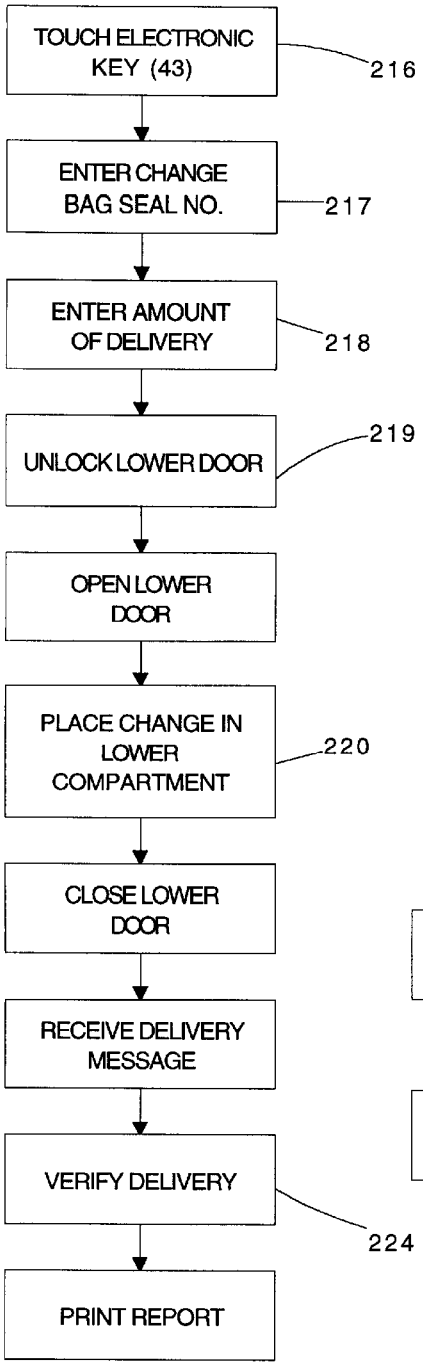
FIG. 14 is a flow chart showing delivery of change according to the preferred embodiment.

Delivering change to the change safe is now described with reference to FIG. 14. In a typical application, change is delivered by an armored-car messenger either at designated dates and times as described below, or in conjunction with scheduled content removal from a drop safe at the same location as the change is safe. A typical change delivery contains a predetermined value of preselected denominations, packaged for placement in the tubes 102 for loading into the columns of the change safe as previously described. The delivery messenger places the change delivery in the lower compartment 34 of the change safe, which is the only part of the change safe accessible to the messenger. To access the lower compartment, the messenger carries an electronic touch key compatible with the key port 43 and programmed with information and the messenger's PIN, required for unlocking the door to the lower compartment, to initiate access as shown at 216 in FIG. 14. The change delivery is in a bag or other container sealed with a numbered bag seal. The messenger is prompted at 217 to enter the number of the seal, and the amount of the change delivery as shown at 218, into the terminal 41. The microprocessor then activates the lower door solenoid 72 as indicated at step 219, allowing the messenger to unlock and open the lower door by turning the knob 35. The messenger places the change into the lower compartment 34 as indicated at 220, and then closes and rebolts the lower door. The lower door switch 64 verifies that closure, and the spring-loaded plunger of the lower door solenoid 72 relocks the bolt assembly of the lower door. The switch 74 associated with the lower-door solenoid confirms that the lower door solenoid has indeed secured the locking mechanism to prevent unauthorized reopening of that door. The terminal 41 then displays a delivery message for verification by the messenger, as indicated at 224 in FIG. 14. After the messenger makes a verifying entry, the printer 42 prints a confirmation of the delivery.

After the messenger has delivered a supply of change to the lower compartment of the change safe, a supervisor can remove that delivery either for loading the change-holding tubes into the columns of the change safe, or adding part or all of the delivered change to the reserve amount stored on the shelves in the upper compartment 78 of the change safe. These operations as discussed with reference to FIG. 15. After entering a supervisory PIN number at step 228 and selecting the appropriate entry on the terminal 41 to remove the change delivery from the lower compartment, the microprocessor again unlocks the lower door and the supervisor can remove the change delivery from the lower compartment. The supervisor is then prompted to close and rebolt the lower door as at 229, whereupon the lower door is relocked as mentioned above. The supervisor then may choose to load tubes from the delivery into the columns, as shown by the decision block 230. By responding "yes", the microprocessor actuates the tube blocker solenoid 140 to unlock the tube blocker 138, as indicated at 232 in FIG. 15. The supervisor then actuates the handle 29 (FIG. 1) to slide the tube blocker to the position where the ports 138*a* align with the ports 28, permitting access to the upper ends of the columns 83. The desired amount of change then is loaded into columns of the change safe by inserting the appropriate tubes into the ports 28 in the upper door of the safe; each port preferably is labeled with the denomination previously selected for that port. The tubes drop within the respective columns, and the tubes in each column (excepting the lowermost tubes) are sensed by the array of photosensors 115 associated with that column. This information is used in reporting the contents of a particular column, as discussed below.

Figure 15:
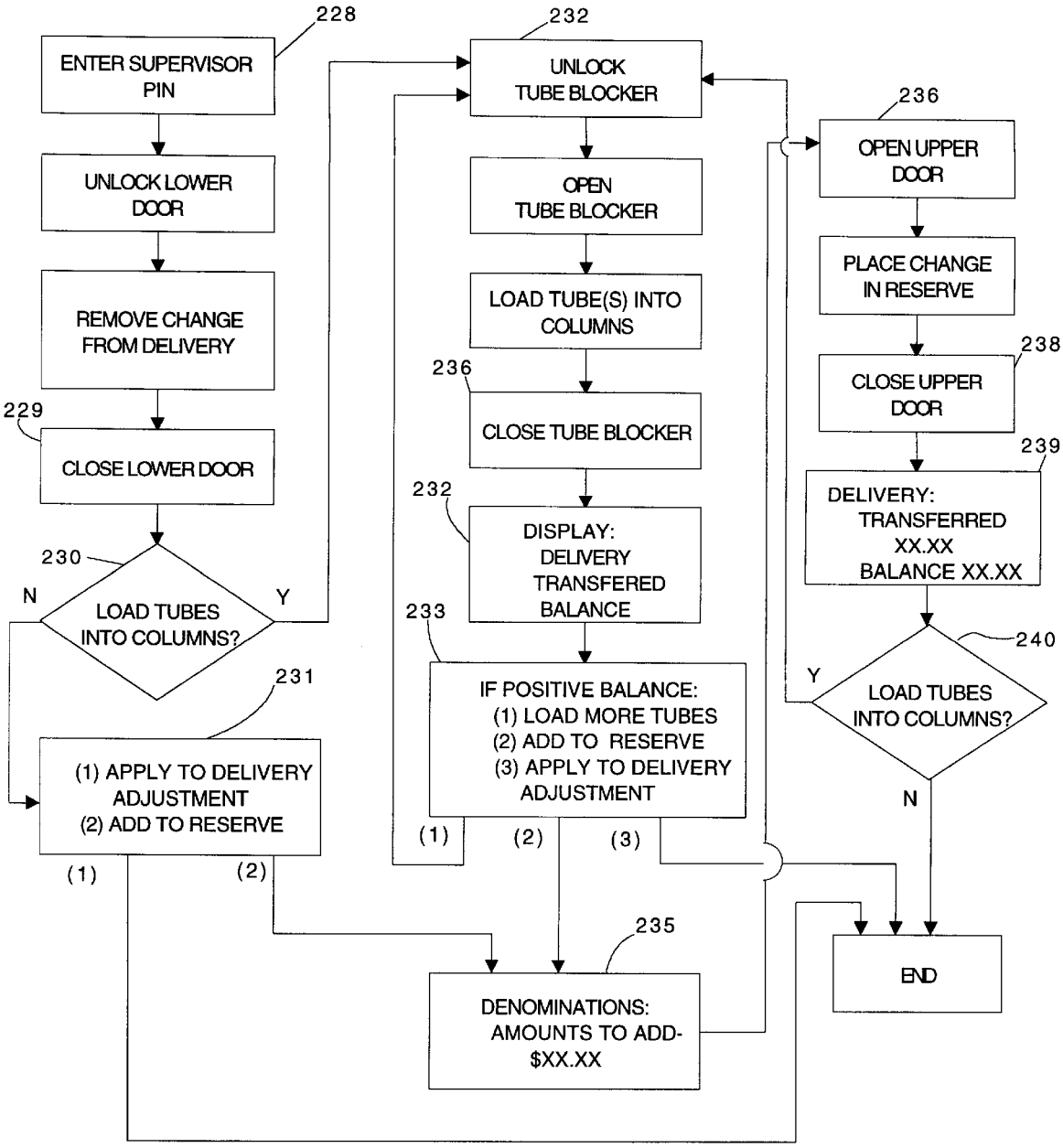
FIG. 15 is a flow chart showing handling of delivered change according to the preferred embodiment.

After the columns are loaded with tubes, the operator moves the handle 29 to close the tube blocker, as indicated at 236 on FIG. 15. The tube blocker switch 142 senses that closure, causing operation of the tube blocker solenoid 140 to lock the tube blocker closed so as to prevent tampering with the columns of the change safe. The terminal 41 now displays the amount of change initially delivered to the safe by the messenger, the amount the supervisor transferred to the columns, and the balance if less than all the delivered change was loaded into the columns. This display is indicated at 232, prompting the operator to select one of the options shown at 233. The first option allows loading more tubes into columns of the change safe, if any column is not already full. Another option allows adding the balance of change to the reserve location within the change safe. A third option is to apply the 33 unused balance to delivery adjustments, which will subsequently print out on the end-of-day report prepared by the change safe or by a drop safe operatively associated with the change safe.

The secure area within the upper compartment 78 behind the upper door 26, is called the reserve area of the change safe. This reserve area has one or more shelves on which change may be stored before being loaded into the tubes. Only a supervisor's PIN can open the upper door 26 to access this area. The particular amount of change transferred to the reserve area to await loading into the columns is accounted for by the change safe and is reported as discussed below.

If the supervisor decides to add change to the reserve, the terminal 41 prompts entry of the amounts for each denomination being added to the reserve, as shown at 235 in FIG. 15. When the supervisor completes those entries, the microprocessor operates the upper door solenoid 57 and prompts the user to open the upper door as indicated at 236. The amount of change previously entered into the terminal then is placed into the reserve location in the upper compartment 78 of the change safe, after which the supervisor closes the upper door as indicated at 238. Closure of the upper door is detected by the upper door switch 49, causing the upper door solenoid to return to the locked position as verified by the upper door solenoid switch 59. The terminal 41 produces a reminder to the operator if the upper door is not closed and locked. The terminal 41 then produces the display 239 indicating the amount transferred to the reserve, the reserve balances, and gives the operator another opportunity to load tubes into the columns as indicated at 240. An affirmative answer causes the change safe to unlock the tube blocker door, allowing the operator to repeat the tube loading operation.

Returning to the decision blocks 230 and 231, the operator upon removing a change delivery from the lower compartment 77 may bypass loading any change into the columns at that time. Instead, the operator may apply the entire amount to the reserve, or to a delivery adjustment, as indicated at 231. Adding that entire amount to the reserve bypasses the tube-loading steps previously described, and instead presents the operator with the instructions as at 235 to enter the amounts by denomination being added to the reserve in the upper compartment 78 of the change safe.

Figure 16:
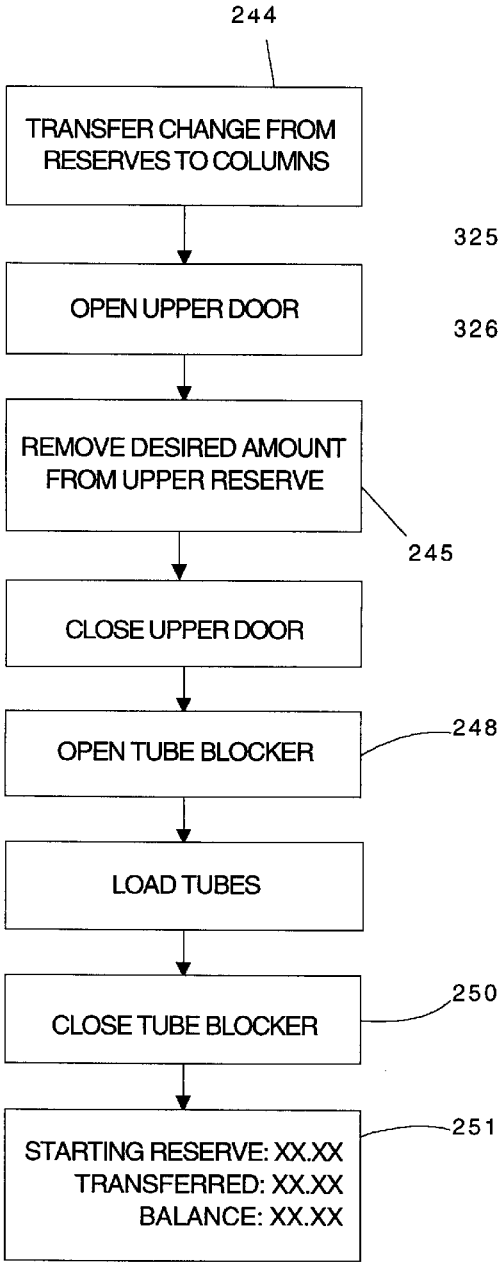
FIG. 16 is a flow chart showing transfer of change from the upper reserve to the columns according to the preferred embodiment.

A supervisory operator can transfer change from the upper reserve to one or more columns of the change safe. This transfer is described with reference to FIG. 16. The supervisor initiates that transfer by the appropriate menu selection on the terminal 41 and enters a supervisory PIN when prompted. The microprocessor then actuates the upper door solenoid 57, whereupon the supervisor can unlock and open the upper door to remove change in a desired amount from the shelf in the upper reserve. The operator must then close and relock the upper door, and that condition enables the tube blocker solenoid 140 and prompts the operator to open the tube blocker as shown at 248 at FIG. 16. The operator then loads the withdrawn change tubes into the columns of the safe, followed by closing the tube blocker door when transfer is completed, as shown at 250. The terminal 41 then produces a display as shown at 251, indicating the amount of money in the reserve location before the transfer, the amount transferred into the columns of the change safe (determined by sensing the tubes dropped into each column and from the predetermined value for each tube), and the amount of any remaining reserve balance. The transfer process is now complete, and control of the change safe is returned to the cashier.

Figure 17:
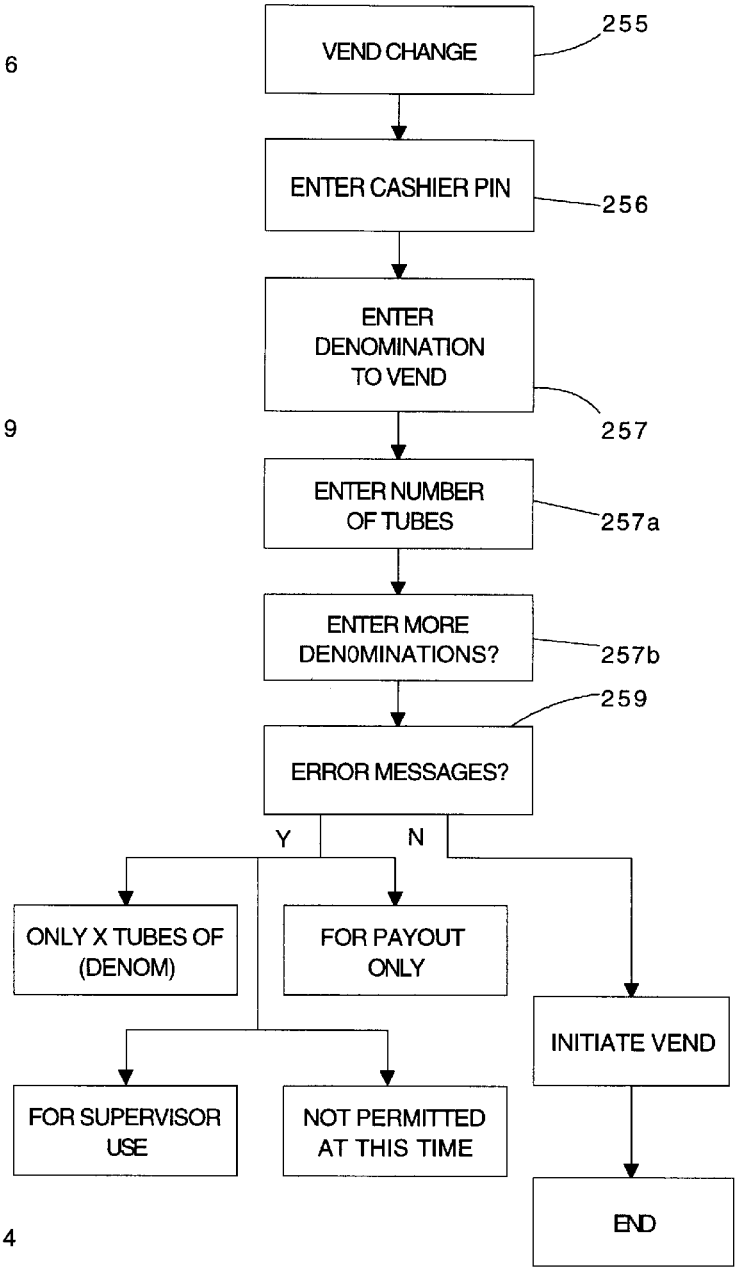
FIG. 17 is a flow chart showing a typical vending operation according to the preferred embodiment.

A typical vending operation for the change safe is illustrated at 255 with respect to FIG. 17. The cashier selects the appropriate entry from the main menu and is prompted to enter his or her PIN into the terminal 41 as indicated at 256. The terminal then presents the cashier with options to vend change of any denomination previously defined for the particular change safe. For example, to vend two rolls of pennies, one roll of nickels, and one roll of dimes, the cashier would twice press the key designated for pennies, then press the key for nickels, and then press the key for dimes. These steps are indicated at 257, 257*a*, and 257*b*. After entering the correct information, the cashier then presses an appropriate key to commence the vend process. However, before vending commences, the microprocessor compares the cashier's request with the attributes previously entered into the change safe for the various denominations chosen for that safe. For example, if the cashier requested a denomination of change during a time of day restricted for that denomination, or requested a denomination vendable only to a supervisor, the terminal 41 displays an appropriate error message as indicated at 259. The cashier then presses a key to clear the previous entries and reenters a new request for change. Alternatively, a cashier can terminate the vending operation and seek assistance from a supervisor, whose PIN will permit the appropriate operation.

Once the requested vend is approved, microprocessor 40 operates the ejector subassembly 85 to perform the requested vend. In the example given, the carriage 146 must be positioned beneath a column previously designated for pennies and presently containing at least one tube of that denomination. The sensor array 185 signals the position of the carriage 146 at the start of the requested vend. If the carriage is not positioned beneath a column containing pennies, the microprocessor 40 signals the carriage position motor 150 to turn the lead screw 147 in the direction required to traverse the carriage to a pennies column holding at least one tube of pennies. The carriage position motor 150 stops when the sensor array 185 indicates the carriage has arrived beneath a pennies column. The microprocessor then operates the ejector motor 171, causing the extractor arm 155 to travel along a complete cycle of movement as previously described, so that the extractor finger 155 engages and rearwardly displaces the tube in the lowermost position of a pennies column. That tube trips the ejector flap 178 and then falls downwardly along the plate 90 to land on the inner end 98 of the ejection chute, from which the tube rolls forwardly to the outer end of the chute 38 for access by the cashier.

The vertical arrays of sensors 115 for each column 83 respond to tubes loaded into the columns at each position except the lowermost position. It is thus possible that a selected vend from a particular column may cause the extractor 154 to cycle through a complete movement path and return to the home position, as detected by the sensor 177, without actually vending anything. However, that absence of a requested vend will be detected by the absence of a signal from the sensor 181 associated with the tube ejection flap 178. Accordingly, if the extractor traverses a complete movement path without vending a tube from a particular column, the microprocessor will traverse the carriage 146 to another available column, if any, for the selected denomination. If no such column presently exists, the terminal 41 indicates the failure of that particular vending operation.

The foregoing mechanical steps of vending are repeated until the change safe completes the vend operations previously requested by and authorized to the cashier. For the requested two tubes of pennies, the carriage remains stationary while the extractor 154 again traverses its predetermined path, ejecting a second tube from the pennies column beneath which the carriage is positioned. When the extractor returns to the home position, the carriage then traverses to a tube containing nickels, and the vending operation is repeated to extract the lowermost tube in that column. The vend operation is complete when the last tube of change requested by the cashier is vended by the change safe.

Figure 18:
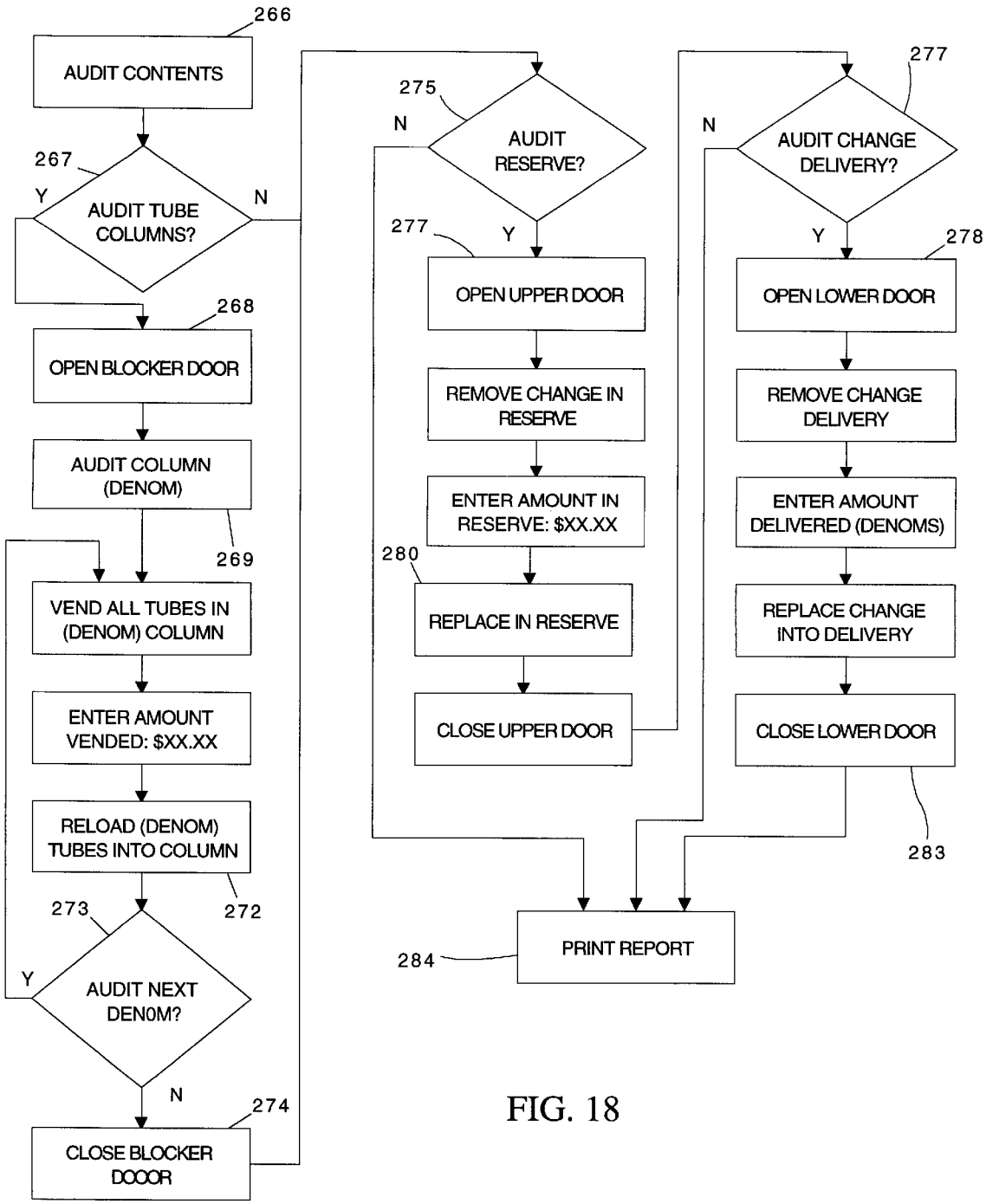
FIG. 18 is a flow chart showing audit functions according to the preferred embodiment.

The audit function 266 performs a partial or complete audit for the contents of the change safe. A complete audit consists of checking the money in the tubes loaded into the delivery columns, and in the lower compartment and the upper reserve area of the change safe. This process is started by choosing the audit function as outlined in FIG. 18. That function is selected from the appropriate menu at the terminal 41 and requires entering a supervisor PIN. The operator then is prompted as at 267 to state whether or not to audit the tube columns. An affirmative answer unlocks the tube blocker door and prompts the operator at 268 to open that door. The change safe then asks the operator in turn whether to audit each denomination set for that safe, as indicated at 269. For example, if the operator wants to audit pennies, the microprocessor commands the change dispensing assembly to vend all tubes in the pennies column(s). The operator then removes those vended tubes, enters the currency amount of the pennies thus vended, and then reloads the pennies tubes into the corresponding column(s) of the change safe, as indicated at 272. The same sequence continues as shown at 273 for the rest of the denominations in the safe, until all columns have been audited or an audit refused for those columns. When this process is complete, the operator is prompted as at 274 to close the blocker door.

The change safe then asks the operator whether to audit the change contained in the upper reserve, as shown at the step 275. A negative answer causes the microprocessor to print a report as described below, detailing the results of the audit for the tube columns.

If the operator requests auditing the reserve, the microprocessor unlocks the upper door to the safe and prompts the operator to open that door as at 277. The operator then removes the change in the reserve, and enters the amount of that change by denomination into the terminal 41. After completing that entry, the operator replaces that change into the reserve as shown as 280 and recloses the upper door. That closure causes the microprocessor to deliver a message asking whether to audit any change delivery remaining in the lower compartment 34 of the safe, as at 277. A negative answer prompts the microprocessor to print a report of the reserve audit and tube-column audit. An affirmative answer results in unlocking the lower door as at 278, and prompting the operator to remove any change delivery in the lower compartment. The operator then is asked to enter the amount of each denomination in that delivery, and then replace that change into the delivery bag and return it to the lower compartment, after which the operator is prompted to close the lower door as at 283. That closure initiates printing a report on the complete audit of the change safe.

A typical printed report 284 for an audit is shown below:

| Column | Denomination | Tube Value | Level | Column Value |
|---|---|---|---|---|
| 1 | Pennies | .50 | 9 | 4.50 |
| 2 | Nickels | 2.00 | 10 | 20.00 |
| 3 | Dimes | 5.00 | 10 | 50.00 |
| 4 | Quarters | 10.00 | 10 | 100.00 |
| 5 | Ones | 20.00 | 10 | 200.00 |
| 6 | Fives | 20.00 | 10 | 200.00 |

-continued

| Column | Denomination | Tube Value | Level | Column Value |
|---|---|---|---|---|
| 7 | Tens | 50.00 | 10 | 500.00 |
| 8 | Twenties | 100.00 | 10 | 1,000.00 |
| 9 | Fifties | 100.00 | 10 | 1,000.00 |
| 10 | Hundreds | 100.00 | 10 | 1,000.00 |
| Tube Contents Value | | | | 4,074.50 |
| Reserve | | | | 655.00 |
| Change Delivered | | | | 2,510.00 |
| Change Safe Total Value | | | | 7,229.50 |

Figure 19:
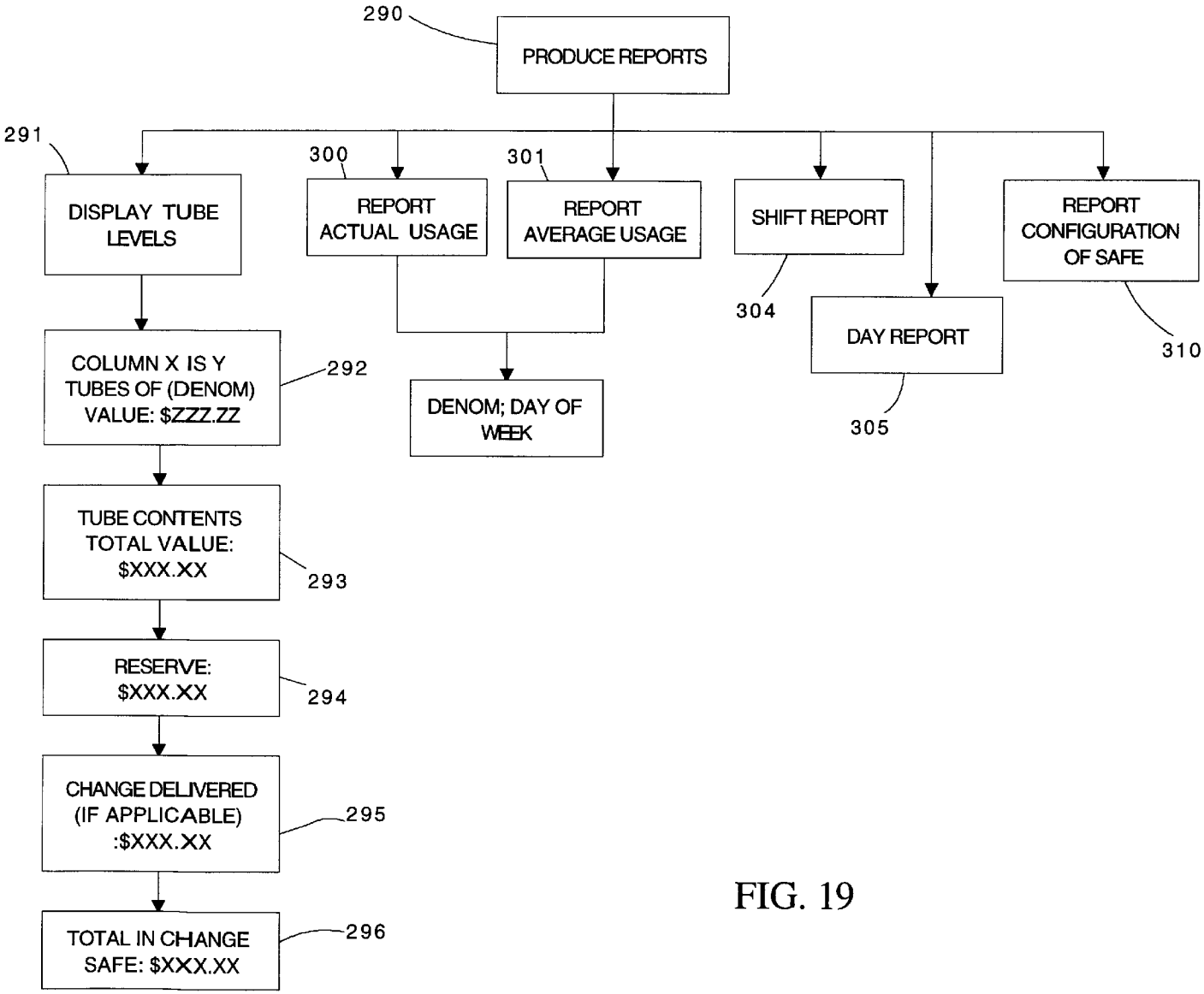
FIG. 19 is a flow chart showing typical audit report functions according to the preferred embodiment.

The present change safe produces various reports on demand, as indicated by the function 290 in FIG. 12, in addition to reports as part of specific functions such as auditing the contents of the safe. FIG. 19 outlines typical reporting functions for the change safe, and these functions usually are supervisory and thus require entering a supervisor's PIN in the terminal 41.

The operator can obtain a quick display of the number of tubes in each column, or a printed report showing those tube levels, as indicated at 291 in FIG. 19. By selecting tube levels, the terminal produces a display beginning with the first column (X), showing the number of tubes (Y), the denomination (Denom.) for that tube, and the amount of money in that column, all as indicated at 292. Thus, the first column (usually pennies) might read:

Column One Level is 5, Tubes of Pennies, Value: $2.50.

Each column configured for a particular denomination is displayed in order, and then the total value of all tubes in the columns is displayed as indicated at 293. The display then shows the total amount in the reserve part of the safe, as at 294, followed by the amount of any change delivery for the lower compartment as shown at 295. The total amount in the column and the reserve is then displayed as at 296.

If the operator instead selects a printed copy of the tube levels, the printer produces a report of the column levels and other information as noted at 292–296.That printed report may resemble the audit report reproduced above, but it should be understood that the present report or display of column levels is based on information from the sensor arrays associated with the columns; the change safe in producing the present report does not vend all tubes from the columns and then require reloading of those tubes as when performing an audit of the safe contents.

The operator also can request a report as at 300 showing actual usage of the funds in the safe, or as at 301 showing average usage of those funds. These reports are printed for all denominations configured to the change safe, showing the usage of each denomination for each day of the week. Reports on actual usage preferably are prepared for the seven days last preceding the date of the requested report, while average-usage reports show average usage of each denomination per day, averaged over a predetermined number of weeks last preceding the requested report.

The change safe is also programmed to print reports of change vended during each operating shift of the safe location, as indicated at 304, and for each business day of the store as indicated at 305. A "business day" for a particular store may not coincide with a calendar day, depending on accounting practices for that store. The reports of change usage by shift and by day are sorted by the cashiers requesting the vends and the denominations vended to each cashier during the time covered by the report.

The supervisor may print a report showing the complete configuration details presently set for the denominations and columns of the change safe. This activity is shown at 310 in FIG. 19. A configuration report lists each denomination configured for the particular change safe, the values and tube values set for those denominations, and the amount of change on hand for each denomination. Moreover, the configuration report indicates the parameters previously set for each denomination, such as the parameters identified above with respect to FIG. 15. A typical configuration report also indicates, by column, the denomination set for each column, and any unused columns presently not configured for a particular denomination. Lastly, the configuration report identifies the schedule of delivery days set for the particular change safe, listed by day of delivery, an earlier day by which change for that delivery must be ordered, and the cutoff time of day for placing that change order.

Figure 20:
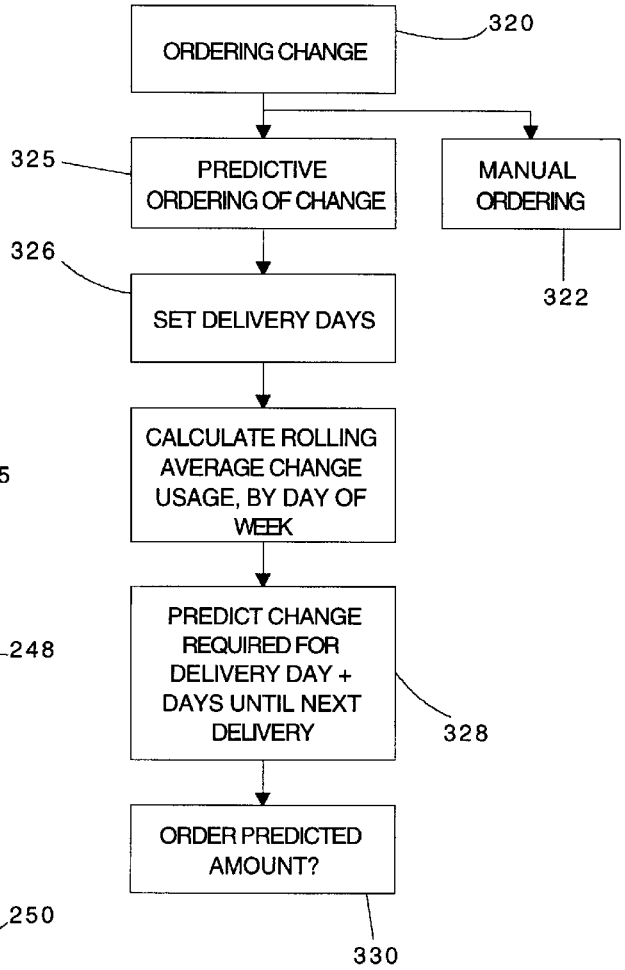
FIG. 20 is a flow chart showing predictive ordering of change according to the preferred embodiment.

Ordering supplies of change for the change safe is an operation detailed at 320 on FIG. 20. The dates and times for change delivery in a typical installation are performed by an armored-car messenger service in accordance with the store supervisor. Knowing those delivery dates and the earlier order-by dates, the supervisor can manually request deliveries of change as indicated at 322, for the next scheduled delivery to that store. As an alternative to manual ordering based on the supervisor's personal estimate of change needs for the day of delivery and the following days until the next scheduled delivery, the change safe can predict the change needs based on historical change usage by day for the particular safe. This predictive ordering is indicated at 325 in FIG. 20. With the delivery days already set as indicated at 326, the microprocessor 40 is programmed to remember the amount of change vended for each denomination, by day, for a predetermined number of weeks in a rolling window of time immediately preceding the present date. The microprocessor calculates average change vends for each denomination per day during that window of time. Based on those average change requirements for each denomination, the known date for the next scheduled delivery of change, and the days between that delivery and the next subsequent scheduled delivery, the microprocessor sums the average usages on those days, for each denomination, and prepares a report of the predicted requirements for the next change delivery. This step is shown at 328 in FIG. 18. The supervisor may then order the amount of change predicted by the change safe as indicated at 330, or may vary that order based on other factors such as anticipated abnormal change requirements for a major holiday occurring between the next two scheduled deliveries of change.

It should be understood that the foregoing relates only to a preferred embodiment of the present invention, and that numerous changes and modifications thereto may be made without departing from the spirit and scope of the present invention as defined in the following claims.

What is claimed is:

1. Apparatus for vending articles of predetermined size, the apparatus comprising:

plural adjacent article-receiving columns each having a certain orientation and configured to accommodate plural articles so that each article placed in a column occupies a predetermined location in the column;

means selectably operative to vend an article from a selected column by removing the article from a terminal location within the column, whereupon other articles remaining in the column will shift locations within the column; and sensors operatively associated with a plurality of the locations in the columns to detect the presence of an article at each such location, so that articles occupying each location of said plurality of locations in each column are detected by the sensors associated with such locations in the columns.

2. Apparatus as in claim 1, wherein the columns have a vertical orientation, and the terminal location is the lowermost location within the column.

3. Apparatus as in claim 2, further comprising:

a loading port at an end of the width of each column for inserting elongate articles endwise into the column in a substantially horizontal attitude and on an axis coincident parallel to the longitudinal extent of the article, whereupon each introduced article drops to a lower location not occupied by an article in that column; and means associated with the end of the column and operative to prevent the elongate articles from dropping in the column until the article is substantially entirely introduced through the loading port into the column, so as to prevent the article from dropping headfirst in the column.

4. Apparatus as in claim 3, wherein:

the means associated with the loading port comprises a structure having a first portion displaced by an article being introduced through the port and a second portion moveable in response to such displacement to prevent the article being introduced from dropping into the column; and the second portion moveable in response to substantially complete entry of the article to the upper end of the column to allow the article to drop within the column.

5. Apparatus as in claim 4, wherein the second portion of the structure moves to block the upper end of the column in the second position so as to support the article being introduced from the loading port; and the second portion is moveable to unblock the upper end in response to introduction of the article past the loading port.

6. Apparatus as in claim 1, wherein:

the sensors associated with the columns comprises a sensor associated with each location of the column except the terminal location and responsive to the presence of an article at said each location; and the vending means is selectably operative to determine whether an article occupies the terminal location of a selected column without regard to whether an article occupies another location in the selected column.

7. Apparatus as in claim 6, further comprising:

structure associated with each column to permit withdrawing a terminal article from the terminal location only in a first direction;

the vending means comprises a displacement element selectably moveable in a first direction, to displace the terminal article in the first direction so as to vend the terminal article from the column; and the vending means is selectably operative to move the displacement element on a predetermined path to urge the terminal article in a direction blocked by the structure and to produce a signal in response to failure of the displacement element to move on the predetermined path, whereby the signal from the vending means indicates the presence of an article in the terminal location in the column.

8. Apparatus as in claim 1, wherein the vending means comprises:

a carriage moveable to a vending location in relation to each column and including a displacement element selectably operative to remove the article at the terminal location of a selected column, whereby the article is vended from the apparatus; and sensors responsive to the location of the carriage in relation to the columns.

9. Apparatus as in claim 8, wherein:

the displacement element is moveable on an orbital path that includes the terminal location in the selected column, so that the displacement element engages and withdraws an article at the terminal location.

10. Apparatus as in claim 9 wherein:

the displacement element is selectably operative to move either in a first direction or in a second direction along the orbital path so as to engage and urge the terminal article; and further comprising means operative to permit withdrawing the terminal article from the selected column only when the displacement element urges the terminal article in the first direction, and to prevent withdrawal of the terminal article when the displacement element urges the terminal article in the second direction so that the displacement element can traverse the orbital path in the second direction only when an article is not in the terminal location; and means responsive to a blocked selected movement of the displacement element in the second direction to produce an indication that the terminal location contains an article.

11. Apparatus for vending articles of predetermined size, the apparatus comprising:

plural adjacent article-receiving columns each having a certain orientation and configured to accommodate an article so that each article placed in a column occupies a predetermined location in the column;

means selectably operative to vend an article from a selected column by removing the article from a terminal location within the column, whereupon other articles remaining in the column will shift locations within the column;

means operatively associated with each predetermined location in the columns to detect the presence of an article at each such location, so that the number of articles in each column is detected by the means associated with the columns;

means operatively associated with the apparatus for receiving and storing signals corresponding to a number of different kinds of articles for vending by the apparatus;

the last-mentioned means also receiving and storing signals corresponding to parameters corresponding to each kind of article; and means operatively associated with the apparatus for receiving and storing signals identifying a particular one of the kinds for storage and vending in selected columns.

12. Apparatus as in claim 11, wherein the different kinds of articles comprise different denominations of money, the parameters correspond to each denomination, and the identifying signals identify a particular said denomination for storage and vending in each column.

13. Apparatus for vending articles of predetermined size, the apparatus comprising:

plural adjacent article-receiving columns each having a certain orientation and configured to accommodate an article so that each article placed in a column occupies a predetermined location in the column;

means selectably operative to vend an article from a selected column by removing the article from a terminal location within the column, whereupon other articles remaining in the column will shift locations within the column;

means operatively associated with each predetermined location in the columns to detect the presence of an article at each such location, so that the number of articles in each column is detected by the means associated with the columns;

means responsive to the number of articles in the column to determine the number of articles vended over a predetermined amount of time past;

means operatively associated with the apparatus for entering a future date of a next delivery of articles to the apparatus; and means responsive to the number of the articles vended in a certain unit of time during the predetermined amount of time and responsive to the units of time remaining until the future date, and operative to produce a predicted number of the articles required for the next delivery based on the past vending.

14. Apparatus as in claim 13, wherein the different kinds of articles comprise different denominations of money received in and vended from the columns, the units of time comprise at least one day, and the predetermined amount of time comprises a plural number of days; and the means responsive to the number of articles is operative to determine the average daily number of money vends for each denomination, and to produce a predicted amount of money needed for each denomination for the next delivery.

15. Apparatus for vending articles of predetermined size, the apparatus comprising:

plural adjacent article-receiving columns each having a certain orientation and configured to accommodate an article so that each article placed in a column occupies a predetermined location in the column;

means selectably operative to vend an article from a selected column by removing the article from a terminal location within the column, whereupon other articles remaining in the column will shift locations within the column;

means operatively associated with each predetermined location in the columns to detect the presence of an article at each such location, so that the number of articles in each column is detected by the means associated with the columns;

means operatively associated with the apparatus for auditing the contents of selected articles in at least some of the columns by commanding the vending means to vend all selected articles from the one or more columns containing the selected articles;

means for producing signals corresponding to the number of selected articles vended; and means for producing a report of the audit, showing the number and description of articles vended from each column during the audit.

16. Apparatus for vending articles of predetermined size and substantially tubular shape, the apparatus comprising:

a plurality of adjacent article-receiving columns each having a vertical orientation;

each column having a width perpendicular to the vertical orientation and configured to accommodate the tubular articles, so that articles placed in a column occupy predetermined locations in the column;

means selectably operative to vend an article from a selected column by removing the article from a lower location within the column, whereupon other articles remaining in the column will shift locations within the column;

a loading port at an end of the width of each column for introducing tubular articles into the column in a substantially horizontal attitude and on an axis coincident to the longitudinal axis of the article, whereupon each introduced article falls in the column to a lower location not occupied by an article in that column; and means associated with the end of the column adjacent the loading port and operative in response to the introduction of the article to support the article until the article is substantially entirely introduced into the column, whereupon the means releases the article to fall in a substantially horizontal orientation within the column.

17. Apparatus as in claim 16, wherein:

the means associated with the end of the column comprises a structure having a first portion positioned for displacement by one end of the tubular article being introduced to the end of the column through the port, and a second portion moveable in response to such displacement to support the article being introduced, thereby preventing the article from falling into the column; and the second portion is operable in response to substantially complete entry of the article to the width of the column to allow the article to fall within the column.

18. Apparatus as in claim 17, wherein;

an edge of the loading port is located in relation to the first portion so as to contact the tubular article as the article is introduced through the loading port to move the second portion to support the article, thereby keeping the first portion displaced with the second portion in position to support the article until the article is substantially fully introduced through the loading port; and the edge is positioned so that a trailing end of the article moves past said edge as the article is substantially completely inserted through the loading port, whereby the second portion can return to a position allowing the article to fall within the column.

* * * * *